US009897376B2

(12) United States Patent
Nakata et al.

(10) Patent No.: US 9,897,376 B2
(45) Date of Patent: Feb. 20, 2018

(54) DRYING METHOD FOR PROCESSING MATERIAL AND HORIZONTAL ROTARY DRYER

(71) Applicant: TSUKISHIMA KIKAI CO., LTD., Tokyo (JP)

(72) Inventors: Yoichi Nakata, Tokyo (JP); Sumito Sato, Tokyo (JP); Satoshi Suwa, Tokyo (JP); Tomonori Watarai, Tokyo (JP)

(73) Assignee: TSUKISHIMA KIKAI CO., LTD, Tokyo (JP)

( * ) Notice: Subject to any disclaimer, the term of this patent is extended or adjusted under 35 U.S.C. 154(b) by 0 days.

(21) Appl. No.: 15/125,443

(22) PCT Filed: Jun. 1, 2015

(86) PCT No.: PCT/JP2015/065780
§ 371 (c)(1),
(2) Date: Sep. 12, 2016

(87) PCT Pub. No.: WO2015/186666
PCT Pub. Date: Dec. 10, 2015

(65) Prior Publication Data

US 2017/0089640 A1 Mar. 30, 2017

(30) Foreign Application Priority Data

Jun. 4, 2014 (JP) ..... 2014-115983

(51) Int. Cl.
*F26B 17/32* (2006.01)
*F26B 25/00* (2006.01)
(Continued)

(52) U.S. Cl.
CPC ..... *F26B 17/32* (2013.01); *C10L 5/04* (2013.01); *C10L 9/08* (2013.01); *F26B 3/02* (2013.01);
(Continued)

(58) Field of Classification Search
CPC ..... F26B 17/32; F26B 3/02; F26B 25/001; C10L 5/04; C10L 9/08; C10L 2290/08
(Continued)

(56) References Cited

U.S. PATENT DOCUMENTS 1,332,137 A * 2/1920 Newhouse ..... F26B 11/028 34/109
1,554,239 A * 9/1925 Sprague ..... F26B 17/003 110/225
(Continued)

FOREIGN PATENT DOCUMENTS

EP 2610569 A1 * 7/2013 ..... F26B 11/0409
EP 2610569 A4 * 12/2014 ..... F26B 11/0409
(Continued)

*Primary Examiner* — Stephen M Gravini
(74) *Attorney, Agent, or Firm* — Muncy, Geissler, Olds & Lowe, P.C.

(57) ABSTRACT

To provide a drying method for processing material and a horizontal rotary dryer allowing easy performance of mass processing of the processing material and enabling size reduction by improving drying performance of the dryer. In a drying method for processing material in which a horizontal rotary dryer provided with: a rotating shell having a feed port for processing material on one end side thereof and a discharge port for processing material on the other end side thereof, and capable of freely rotating around an axial center; and a group of heating tubes through which a heating medium passes, provided within the rotating shell, and configured in a manner that the processing material is lifted up in a rotational direction by the group of heating tubes in accordance with the rotation of the rotating shell, is used, and the processing material is dried, through indirect heating, by using the group of heating tubes in a process of feeding the processing material to the one end side of the rotating shell and discharging the processing material from the other end side of the rotating shell, the rotating shell is
(Continued)

rotated to make a critical speed ratio α defined by the following expression 1 and expression 2 become 30 to less than 100% to dry the processing material, $$Vc=2.21D1/2 \quad \text{Expression 1}$$

$$\alpha=V/Vc\cdot 100 \quad \text{Expression 2}$$

wherein Vc indicates a critical speed (m/s), D indicates an inside diameter (m) of the rotating shell, α indicates the critical speed ratio (%), and V indicates a rotation speed (m/s).

10 Claims, 30 Drawing Sheets

(51) Int. Cl.
*F26B 3/02* (2006.01)
*C10L 5/04* (2006.01)
*C10L 9/08* (2006.01)

(52) U.S. Cl.
CPC ..... *F26B 25/001* (2013.01); *C10L 2290/08* (2013.01)

(58) Field of Classification Search
USPC ..... 34/199, 173
See application file for complete search history.

(56) References Cited

U.S. PATENT DOCUMENTS 2,030,734 A * 2/1936 Dudley ..... F26B 17/003 159/11.3
3,674,449 A * 7/1972 Schmalfeld et al. ..... C10L 5/04 264/122
4,337,583 A * 7/1982 Harris ..... B01F 7/00558 34/180
4,864,942 A * 9/1989 Fochtman ..... B09B 3/0091 110/226
5,271,163 A * 12/1993 Pikus ..... F26B 17/20 34/181
5,566,469 A * 10/1996 Bolton ..... F26B 11/0463 34/135
5,746,006 A * 5/1998 Duske ..... F26B 11/0477 34/136
5,791,066 A * 8/1998 Crews ..... B04C 5/08 34/168
6,185,842 B1 * 2/2001 Brashears ..... E01C 19/1063 34/137
7,380,348 B2 * 6/2008 Seebach ..... B04C 3/00 34/326
8,726,532 B2 * 5/2014 Hogan ..... F26B 17/103 15/345
8,793,897 B2 * 8/2014 Brosig ..... C04B 11/007 106/772
9,429,362 B2 * 8/2016 Kanai ..... F26B 17/22
9,671,166 B2 * 6/2017 Plavnik ..... F26B 7/00
9,683,779 B2 * 6/2017 Kataoka ..... F26B 17/32
2013/0174436 A1 * 7/2013 Kataoka ..... F26B 11/0409 34/109
2015/0247101 A1 * 9/2015 Sudo ..... C10L 5/04 44/530
2016/0145520 A1 * 5/2016 Koulik ..... B01J 19/088 44/606
2016/0355744 A1 * 12/2016 Nakagawa ..... C10L 9/06
2017/0089640 A1 * 3/2017 Nakata ..... F26B 17/32
2017/0145642 A1 * 5/2017 Swanson ..... F26B 17/32
2017/0248365 A1 * 8/2017 Kataoka ..... F26B 11/045

FOREIGN PATENT DOCUMENTS

EP 2610569 B1 * 4/2017 ..... F26B 11/0409
JP 58-501245 A 7/1883
JP 62-60632 A 3/1987
JP 4-345687 A 12/1992
JP 5-126468 A 5/1993
JP 2515070 Y2 10/1996
JP 2002-22363 A 1/2002
JP 2012-47361 A 3/2012
JP 2014-55687 A 3/2014
JP 5502656 B2 * 5/2014 ..... F26B 11/0409
WO WO 83/00546 A1 2/1983
WO WO 2012026285 A1 * 3/2012 ..... F26B 11/0409

* cited by examiner

| | DRY | PENDULAR REGION | FUNICULAR REGION 1 | FUNICULAR REGION 2 | CAPILLARY REGION | SLURRY |
|---|---|---|---|---|---|---|
| SOLID PHASE | CONTINUOUS | CONTINUOUS | CONTINUOUS | CONTINUOUS | DISCONTINUOUS | DISCONTINUOUS |
| LIQUID PHASE | 0 | DISCONTINUOUS | CONTINUOUS | CONTINUOUS | CONTINUOUS | CONTINUOUS |
| GAS PHASE | CONTINUOUS | CONTINUOUS | CONTINUOUS | DISCONTINUOUS | 0 | 0 |
| STATE | VERY DRIED 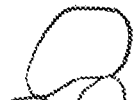 | DRIED  | DRIED  | STICKY  | STICKY  | MUSHY  |

FIG. 30

DRYING METHOD FOR PROCESSING MATERIAL AND HORIZONTAL ROTARY DRYER

TECHNICAL FIELD

The present invention relates to a drying method for processing material and a horizontal rotary dryer improving a drying rate.

BACKGROUND ART

As a dryer which dries processing materials such as coals or ores, a steam tube dryer (which is referred to as "STD", hereinafter), a coal-in-tube (Patent Document 1), a rotary kiln, and the like are often used. The aforementioned coals or ores are used as raw materials for iron making or refining, fuel for power generation, and the like, and since it is demanded to process a mass of the coals or ores in a stable manner, the above-described respective dryers have been employed as dryers which fulfill the demand.

The STD indirectly heats the processing materials, so that a thermal efficiency is high, and a processing amount per unit volume is also large. Further, it is also possible to increase a size of the STD, so that the STD fulfills the demand regarding mass processing.

The coal-in-tube also indirectly heats the processing materials, so that a thermal efficiency is high, and a processing amount per unit volume is also large, in a similar manner to the aforementioned STD. However, there is a disadvantageous point that a size thereof is difficult to be increased, when compared to the STD. For example, when an amount capable of being processed by one STD described above is tried to be processed by the coal-in-tube, a plurality of the coal-in-tubes are sometimes required.

The rotary kiln applies hot air to the processing materials to directly dry the processing materials, and thus it has a disadvantageous point that a heat efficiency is lower than that provided by the indirect heating. Further, there is also a disadvantageous point that an exhaust gas processing facility becomes very large. From the reasons as described above, the STD has precedence as the dryer which processes a mass of processing materials.

PRIOR ART DOCUMENT

Patent Document

Patent Document 1: Publication of Utility Model Registration No. 2515070

Patent Document 2: Japanese Examined Patent Application Publication No. Sho 62-60632

DISCLOSURE OF THE INVENTION

Problems to be Solved by the Invention

In recent years, the demand regarding the drying processing of mass of the processing materials is strong, and in order to meet the demand, a size of the dryer is becoming larger. When the increase in size of the STD is cited as an example, the STD whose shell diameter is 4 in and whose main body length is 30 in or longer is manufactured.

However, the increase in size of the dryer creates not only a problem such that an installation area has to be increased, but also problems in terms of manufacture and transportation. Concretely, a plate thickness of each member is increased to maintain strength, and weight of the main body of the aforementioned STD whose shell diameter is 4 in and whose main body length is 30 in, reaches 400 tons. Accordingly, there is a problem that it takes a lot of time until when the manufacture is completed. Further, there is also a problem that a special facility is required for the manufacture.

Further, in accordance with the increase in size, when a product is transported, a special vehicle capable of supporting weight of the product becomes required, and when a transportation route is narrow, the product has to be divided to be transported, and joined and assembled at a job site, and thus the construction work is very complicated, which is also a problem.

Accordingly, there was found out a task that, based on the fact that there is a limitation in the increase in size of the apparatus as described above, the aim should rather be to improve a drying rate of a processing material.

Therefore, the task of the present invention is to improve a drying rate of processing material dried by a dryer.

Further, the task of the present invention is to avoid the above-described problems in accordance with the increase in size of the apparatus to the utmost, by the present invention capable of increasing a drying processing amount per size (shell diameter) of the dryer.

Means for Solving the Problems

The present invention solving the above-described problems is as follows.

<Invention Described in Claim 1>

A drying method for processing material using a horizontal rotary dryer provided with: a rotating shell having a feed port for processing material on one end side thereof and a discharge port for processing material on the other end side thereof, and capable of freely rotating around an axial center; and a group of heating tubes through which a heating medium passes, provided within the rotating shell, and configured in a manner that the processing material is lifted up in a rotational direction by the group of heating tubes in accordance with the rotation of the rotating shell, the drying method for processing material including drying, through indirect heating, the processing material by using the group of heating tubes in a process of feeding the processing material to the one end side of the rotating shell and discharging the processing material from the other end side of the rotating shell, in which the rotating shell is rotated to make a critical speed ratio α defined by the following expression 1 and expression 2 become 30 to less than 100% to dry the processing material, $$Vc=2.21D^{1/2} \quad \text{Expression 1}$$

$$\alpha=V/Vc\cdot 100 \quad \text{Expression 2}$$

wherein Vc indicates a critical speed (m/s), D indicates an inside diameter (in), α indicates the critical speed ratio (%) of the rotating shell, and V indicates a rotation speed (m/s).

(Operation and Effect)

Conventionally, operation has been conducted based on the following value without performing theoretical verification regarding a number of rotations of a rotating shell of STD. Specifically, when an inside diameter of the rotating shell is 4 in, operation has been conducted by setting an upper limit of a number of rotations to 2 to 4.5 rpm, when the inside diameter is 3 in, operation has been conducted by setting the upper limit of the number of rotations to 2 to 5 rpm, when the inside diameter is 2 in, operation has been conducted by setting the upper limit of the number of rotations to 2 to 6 rpm, and when the inside diameter is 1 in, operation has been conducted by setting the upper limit of the number of rotations to 3 to 10 rpm.

On the other hand, according to the findings of the present inventors, there is a problem that when a size of the STD (the inside diameter of the rotating shell) is changed, even if the STD is rotated with the same number of rotations, a drying rate of the processing material changes, and it is difficult to predict the rate. Particularly, as the STD becomes large, it becomes further difficult to predict the drying rate, so that a heat transfer area has been previously designed to be a large area, to thereby give a margin to drying performance.

Due to such reasons, it has been difficult, in the conventional example, to bring out desired drying performance when a scale-up is performed from a test machine to an actual machine. On the contrary, by using the drying method for processing material according to the present invention to decide the rotation speed, it becomes easy to bring out the desired drying performance when the scale-up is conducted.

Further, in the drying method for processing material of the present invention, by increasing the rotation speed of the dryer, the drying performance can be dramatically improved when compared to the conventional drying performance, and thus it becomes possible to perform mass processing of processing material.

<Invention Described in Claim 2>

In the drying method for processing material described in claim 1, the processing material is fed into the rotating shell to make a hold up ratio η of the processing material defined by the following expression 3 become 20 to 40%, $$\eta = Ap/Af \cdot 100 \qquad \text{Expression 3}$$

wherein η indicates the hold up ratio (%), Ap indicates a cross-sectional area ($m^2$) occupied by the processing material with respect to a free cross-sectional area, and Af indicates a free cross-sectional area ($m^2$) as a result of subtracting a cross-sectional area of all of the heating tubes from the entire cross-sectional area of the rotating shell.

(Operation and Effect)

If the hold up ratio η is 20 to 40%, a processing amount per unit cross-sectional area becomes large, and besides, the drying rate also becomes fast. Further, since the upper limit of the hold up ratio η is not excessively large, good drying rate is provided. A more preferable hold up ratio η is 25 to 30%. Note that the entire cross-sectional area Af of the rotating shell indicates a cross-sectional area of the inside of the rotating shell at an arbitrary transverse section of the rotating shell, and does not include an area of a thick wall portion of the rotating shell. Specifically, the entire cross-sectional area Af indicates a cross-sectional area calculated based on an inside diameter of the rotating shell.

<Invention Described in Claim 3>

In the drying method for processing material described in claim 1 or 2, when the processing material is coal whose median diameter is 50 mm or less, the rotating shell with an inside diameter of 1 to 6 in is used, and the rotating shell is rotated to make the critical speed ratio α become 40 to less than 100% to dry the processing material.

(Operation and Effect)

When the processing material is coal, the critical speed ratio α of 40 to less than 100% is optimum from a viewpoint of processing amount and drying rate. A more preferable critical speed ratio α is 60 to 90%.

<Invention Described in Claim 4>

In the drying method for processing material described in claim 1 or 2, when the processing material is a resin-based material whose median diameter is 200 μm or less, the rotating shell with an inside diameter of 1 to 6 in is used, and the rotating shell is rotated to make the critical speed ratio α become 30 to 70% to dry the processing material.

(Operation and Effect)

When the processing material is the resin-based material with the median diameter of 200 μm or less, the critical speed ratio α of 30 to 70% is optimum from a viewpoint of processing amount and drying rate. A more preferable critical speed ratio α is 40 to 60%.

<Invention Described in Claim 5>

In the drying method for processing material described in claim 1 or 2, a plurality of the heating tubes are arranged in a radial manner or on concentric circles, and a separation distance between adjacent heating tubes is 80 to 150 mm.

(Operation and Effect)

The separation distance between the adjacent heating tubes relates to an amount by which the processing material is scooped up in accordance with the rotation of the rotating shell, and an amount by which the scooped-up processing material falls to return to a position between the heat transfer tubes, and besides, these amounts are associated with the rotation speed of the rotating shell as well, and it was found out that the separation distance of 80 to 150 mm is suitable.

<Invention Described in Claim 6>

A horizontal rotary dryer, including: a rotating shell having a feed port for processing material on one end side thereof and a discharge port for processing material on the other end side thereof, and capable of freely rotating around an axial center; and a group of heating tubes through which a heating medium passes, provided within the rotating shell, configured in a manner that the processing material is lifted up in a rotational direction by the group of heating tubes in accordance with the rotation of the rotating shell, and drying, through indirect heating, the processing material by using the group of heating tubes in a process of feeding the processing material to the one end side of the rotating shell and discharging the processing material from the other end side of the rotating shell, in which the horizontal rotary dryer is configured to be able to operate to make a critical speed ratio α defined by the following expression 1 and expression 2 become 30 to less than 100%, $$Vc = 2.21 D^{1/2} \qquad \text{Expression 1}$$

$$\alpha = V/Vc \cdot 100 \qquad \text{Expression 2}$$

wherein Vc indicates a critical speed (m/s), D indicates an inside diameter (in) of the rotating shell, α indicates the critical speed ratio (%), and V indicates a rotation speed (m/s).

(Operation and Effect)

From a viewpoint of the apparatus, operation and effect similar to those of claim 1 are obtained.

<Invention Described in Claim 7>

In the horizontal rotary dryer described in claim 6, a plurality of the heating tubes are arranged in a radial manner or on concentric circles, and a separation distance between adjacent heating tubes is 80 to 150 mm.

(Operation and Effect)

From a viewpoint of the apparatus, operation and effect similar to those of claim 5 are obtained.

(Another Invention)

A drying rate evaluation method for processing material being a method in which a horizontal rotary dryer provided with: a rotating shell having a feed port for processing material on one end side thereof and a discharge port for processing material on the other end side thereof, and capable of freely rotating around an axial center; and a group of heating tubes through which a heating medium passes, provided within the rotating shell, and configured in a manner that the processing material is lifted up in a rotational direction by the group of heating tubes in accordance with the rotation of the rotating shell, is used, and a drying rate of the processing material when the processing material is dried, through indirect heating, by the group of heating tubes in a process of feeding the processing material to the one end side of the rotating shell and discharging the processing material from the other end side of the rotating shell, is evaluated, the drying rate evaluation method for processing material including evaluating the drying rate by using a critical speed ratio α defined by the following expression 1 and expression 2, $$Vc=2.21D^{1/2} \quad \text{Expression 1}$$

$$\alpha=V/Vc\cdot 100 \quad \text{Expression 2}$$

wherein Vc indicates a critical speed (m/s), D indicates an inside diameter (in) of the rotating shell, α indicates the critical speed ratio (%), and V indicates a rotation speed (m/s).

(Operation and Effect)

Operation and effect similar to those of claim 1 are obtained. Further, with the use of the evaluation method of the drying rate according to the present claim, it is possible to obtain a precise indirect heating horizontal rotary dryer at an actual machine level.

Effect of the Invention

As described above, according to the present invention, it is possible to improve the drying rate of the processing material dried by the dryer. Further, as a result of the improved drying rate, it is possible to increase the drying processing amount per size (shell diameter) of the dryer. Conversely, it is possible to reduce the size of the apparatus per processing amount.

BRIEF DESCRIPTION OF DRAWINGS

FIG. 30 is a table which explains adhesive properties of materials to be processed.

BEST MODE FOR CARRYING OUT THE INVENTION

Figure 1:
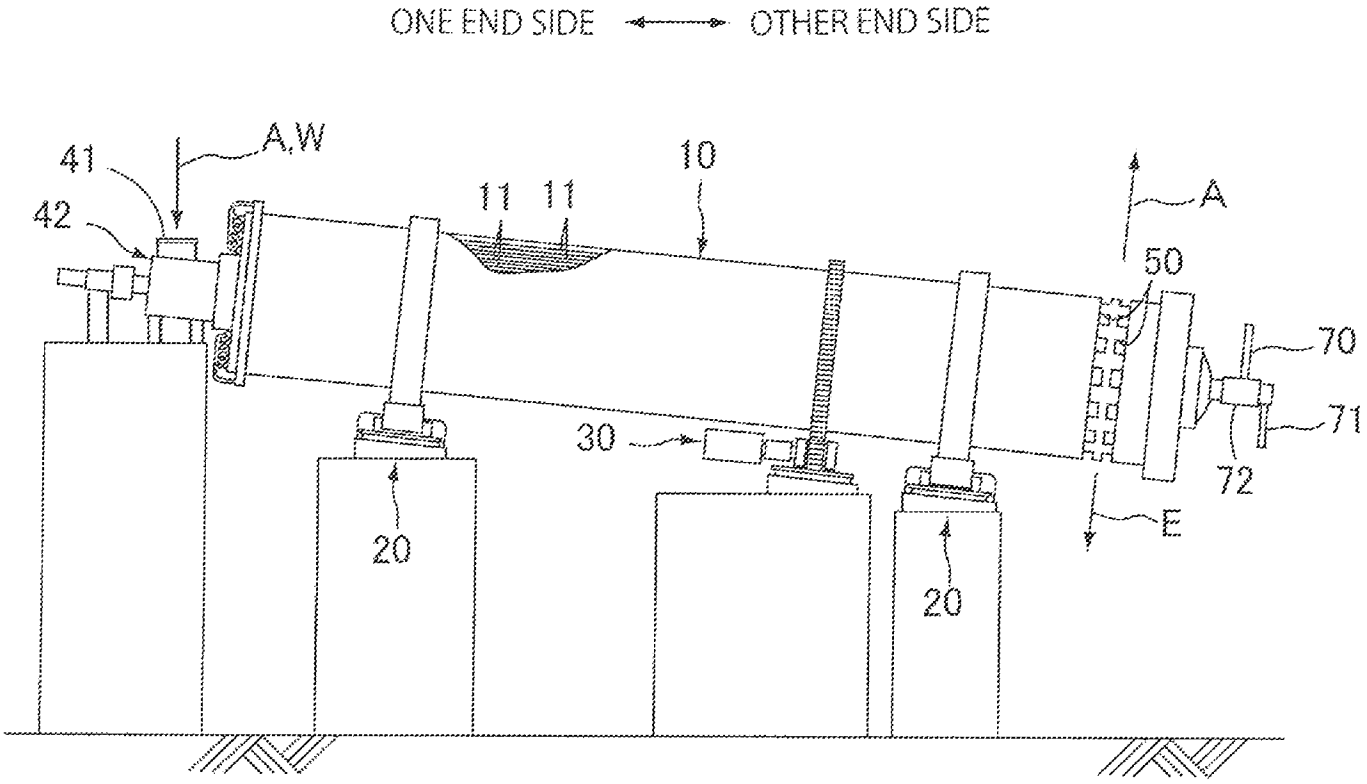
FIG. 1 is a side view of a horizontal rotary dryer according to the present invention.

Hereinafter, preferred embodiments of the present invention will be further described by using the drawings. Note that the following description and drawings merely illustrate one example of the embodiments of the present invention, and the contents of the present invention should not be construed as being limited to the embodiments.

(Gist of Invention)

Generally, a drying rate of a dryer can be represented as the following expression 4, $$Q=Uoa\times Aef\times Tln \quad \text{Expression 4}$$

wherein Q indicates a heat transfer amount (W), Uoa indicates an overall heat transfer coefficient ($W/m^2$-K), Aef indicates an effective contact heat transfer area ($m^2$), and Tln indicates a temperature difference (° C.).

The drying rate is synonymous with the heat transfer amount Q, and in order to increase the heat transfer amount Q on the left side of the aforementioned expression 4, it is only required to take a measurement such that any one or all of the overall heat transfer coefficient Uoa, the effective contact heat transfer area Aef, and the temperature difference Tln on the right side of the expression 4 is/are increased.

The present inventor focused attention on the overall heat transfer coefficient Uoa and the effective contact heat transfer area Aef, and considered, in order to increase these, providing a faster relative contact speed between a heat transfer surface and the material to be dried W, and providing a larger effective contact heat transfer area between the heat transfer surface and the material to be dried W by improving dispersion of the processing material W. When various experiments and studies were actually conducted, it was possible to clearly confirm the effectiveness of the method of the present invention.

Besides, as a result of analyzing the high-speed rotation technique according to the present invention in detail, it was found out that the idea of the present invention can be applied also to a case where a diameter of a rotating shell 10 of a dryer is different.

(Processing Material W)

First, there is no limitation regarding a processing material W as a drying target, and as a concrete example of the processing material W, there can be cited coal, ore such as copper ore, iron powder, or zinc powder, a metallic material, terephthalic acid, a resin-based material such as polyethylene, polyacetal, or vinyl chloride, methionine, a processed food-based material such as gluten meal, soybean processed powder, corn fiber, or corn germ, an inorganic material such as gypsum, alumina, or soda ash, dehydrated sludge, or the like.

The processing material W is preferably one whose surface is not sticky and thus having a low adhesive property. FIG. 30 illustrates a table cited from an explanatory diagram 5 on page 17 of an explanatory manual of Association of Powder Process Industry and Engineering, Japan Standard SAP 15-13, 2013. In the present invention, materials within a region surrounded by a dotted line in FIG. 30, which are, in detail, dried materials, materials in a pendular region, materials in a funicular region 1, materials in a funicular region 2, and materials in a capillary region, are preferably used as the processing material W. Slurry is not suitable for the processing material W in the present invention since it tends to have extremely high adhesive property.

(Median Diameter)

A median diameter of the present invention is defined by using the following method, for example. In detail, when a particle diameter of the processing material W is 500 micrometers or more, sieving is performed according to a method described in a coal testing method of JIS (Japan Industrial Standard) M 8801, a result of the sieving is represented by Rosin-Rammler distribution, and a particle diameter when a cumulative mass (oversize) corresponds to 50% is defined as a median diameter ($D_{50}$). Further, when the particle diameter of the processing material W is less than 500 micrometers, a particle size distribution is measured by using a laser diffraction type particle size distribution measuring apparatus (for example, SALD-3100, which is a product name manufactured by SHIMADZU CORPORATION), and a particle diameter when an accumulated volume corresponds to 50% is defined as a median diameter ($D_{50}$).

(Indirect Heating Horizontal Rotary Dryer)

Figure 5:
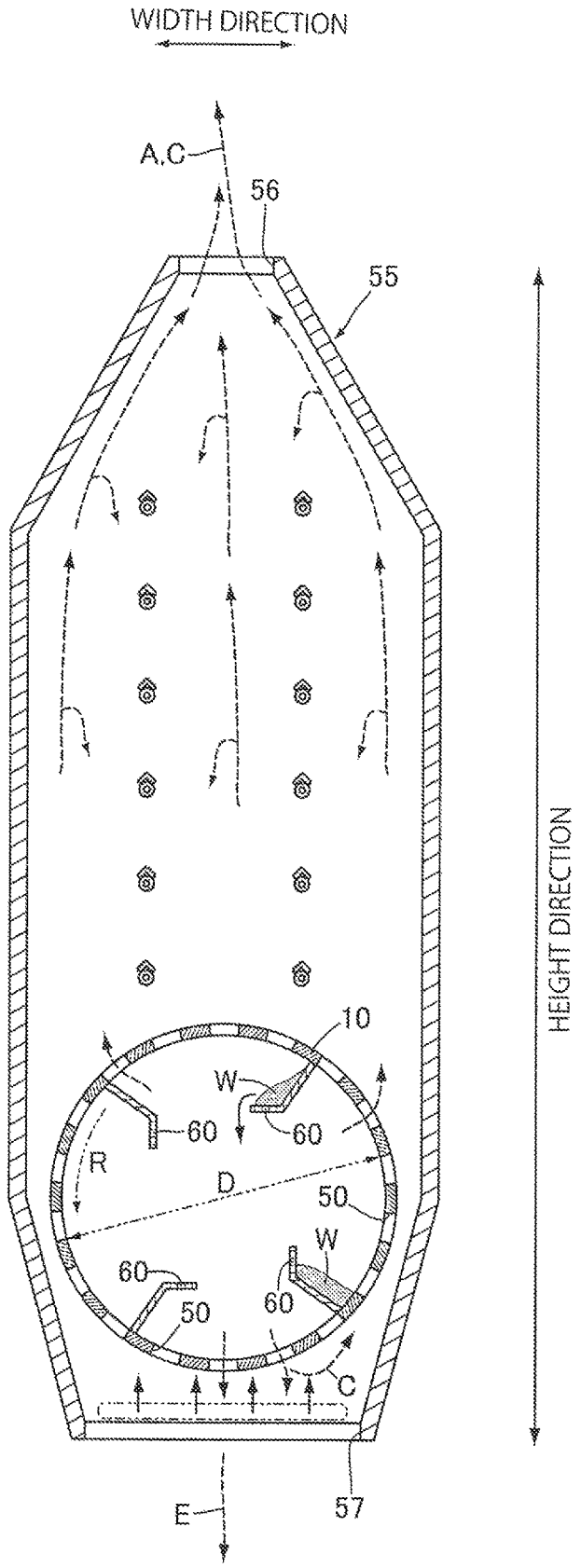
FIG. 5 is a sectional view taken along line X-X in FIG. 4.

Next, a horizontal rotary dryer according to the present invention (which is also referred to as "STD (abbreviated name of Steam Tube Dryer)", hereinafter) will be described. The horizontal rotary dryer has a structure as exemplified in FIG. 1, in which a cylindrical rotating shell 10 is provided, the rotating shell 10 is installed so that its axial center slightly inclines with respect to a horizontal plane, and one end of the rotating shell 10 is positioned higher than the other end of the rotating shell 10. At a position below the rotating shell 10, two support units 20 and a motor unit 30 are installed so as to support the rotating shell 10, and the rotating shell 10 is designed to be able to freely rotate around its axial center with the use of the motor unit 30. The rotating shell 10 is designed to rotate in one direction. The direction can be arbitrarily determined, and, for example, as illustrated in FIG. 5, it is possible to make the rotating shell 10 rotate counterclockwise (in an arrow mark R direction) when looking at one end side (a feed port 41 side of processing material W) from the other end side (a discharge port side of processing material W).

Inside the rotating shell 10, a large number of steam tubes (heating tubes) 11 each being a pipe made of metal, are attached to extend along the axial center of the rotating shell 10, as heat transfer tubes for the material to be dried W. A plurality of the steam tubes 11 are arranged in a circumferential direction and in a radial direction, respectively, so as to form concentric circles around the axial center of the rotating shell 10, for example. Forms of the arrangement will be described later in detail. Note that the heating tubes 11 are warmed when steam or the like being a heating medium flows through the inside of the heating tubes 11.

Further, in the vicinity of the screw feeder 42, there is provided a gas blowing unit (not illustrated) which blows air, inert gas, or the like as the carrier gas A into the rotating shell 10 from the feed port 41 which also serves as a gas blowing opening, and the carrier gas A blown by the gas blowing unit flows through the inner part of the rotating shell 10 toward the other end side of the rotating shell 10.

Figure 3:
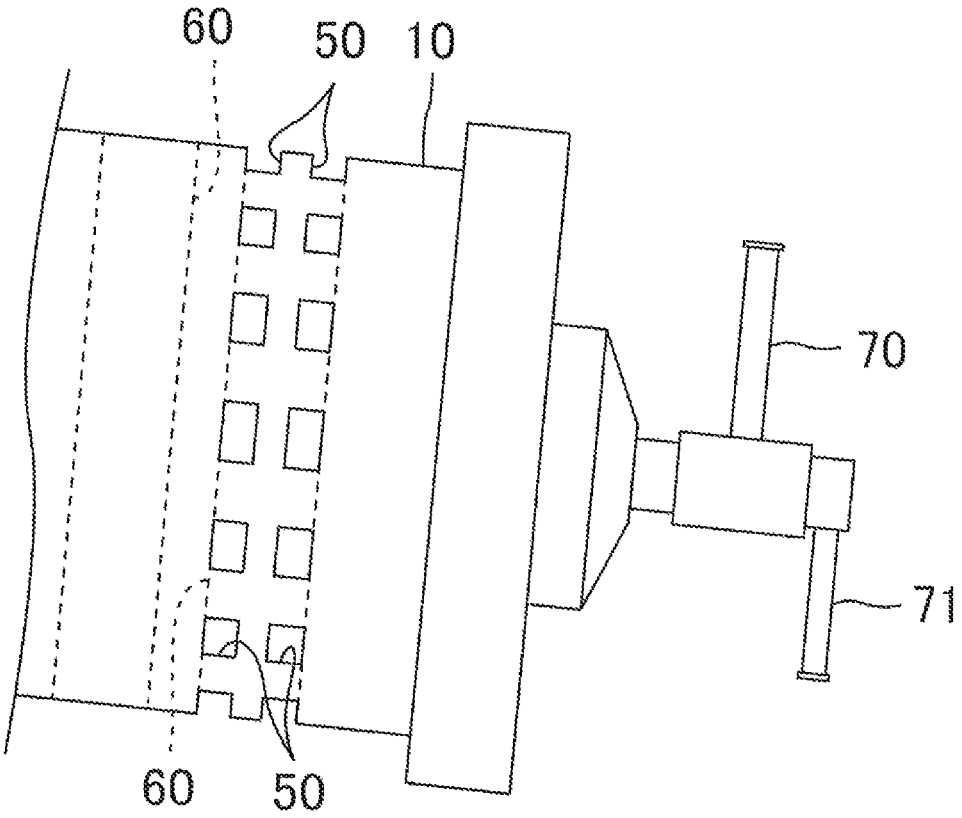
FIG. 3 is an enlarged view (side view) of the other end side of a rotating shell.

As illustrated in FIG. 1 and FIG. 3, on a peripheral wall on the other end side of the rotating shell 10, a plurality of discharge ports 50 are penetrated to be formed. The plurality of discharge ports 50 are formed along the circumferential direction of the rotating shell 10, and in the examples of FIG. 1 and FIG. 3, the discharge ports 50 are formed by being separated from one another so as to make two lines. Further, all of the plurality of discharge ports 50 are formed in the same shape, but, they may also be formed in different shapes.

Further, on the other end side of the rotating shell 10, a gas pipe 72 is provided, and a feed pipe 70 feeding steam into the steam tubes 11 and a drain pipe 71 are provided.

Modified Example

Figure 4:
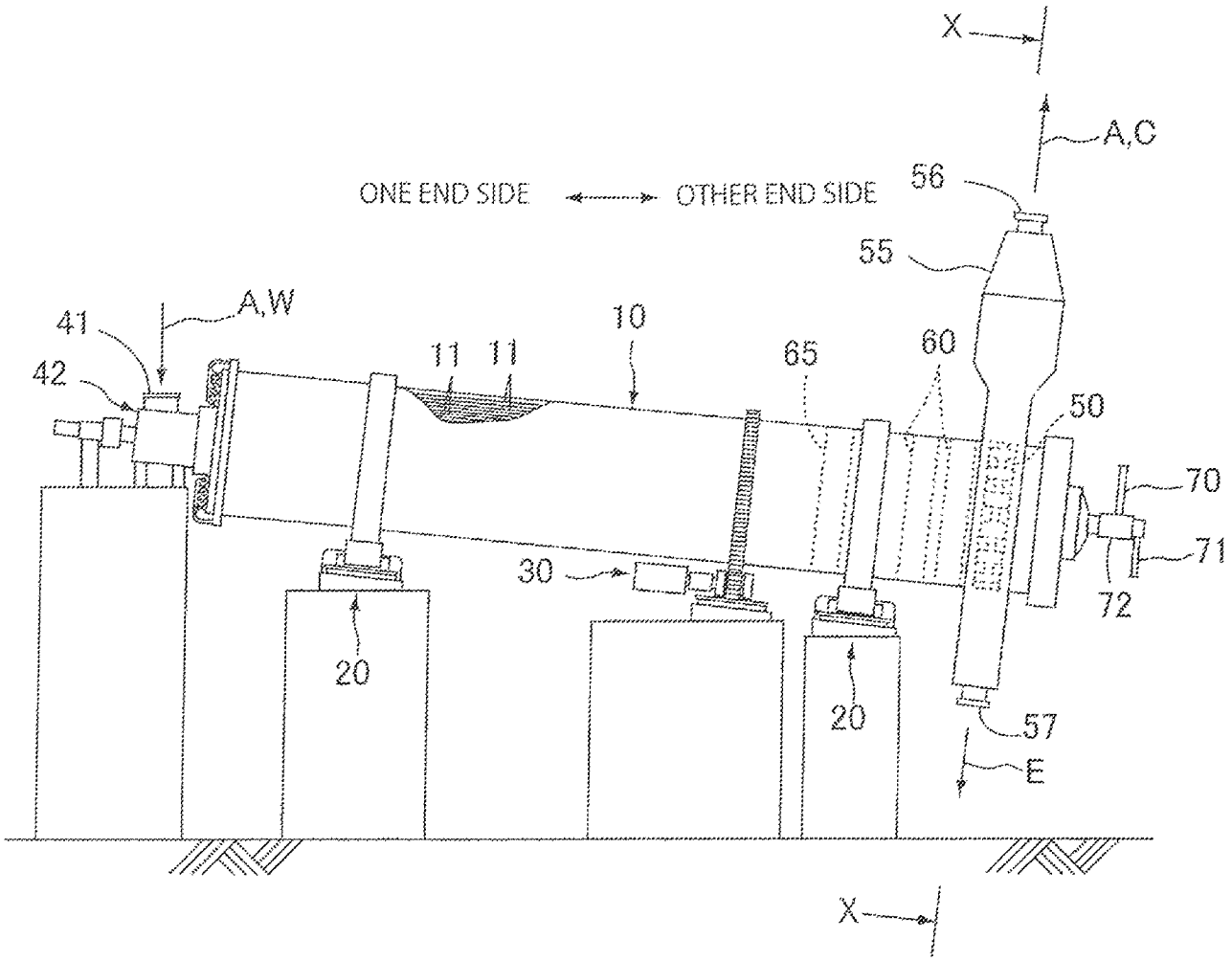
FIG. 4 is a side view of a horizontal rotary dryer (modified example) according to the present invention.

Note that as illustrated in FIG. 4, it is also possible to provide an agitating unit 65 that agitates the processing material W, at a position on the other end side of the rotating shell 10.

Further, as illustrated in FIG. 4 and FIG. 5, it is also possible that a classification hood 55 capable of discharging the processing material W and carrier gas A is provided to the rotating shell 10 so as to cover the other end side of the rotating shell 10 having the plurality of discharge ports 50. The classification hood 55 is formed of thick metal, and it has, in a bottom surface, a fixed discharge port 57 from which the processing material W after being subjected to drying and classification, namely, the processed material E is discharged, and has, in a ceiling surface, a fixed exhaust gas opening 56 from which the carrier gas A is exhausted.

(Drying Process)

Figure 2:
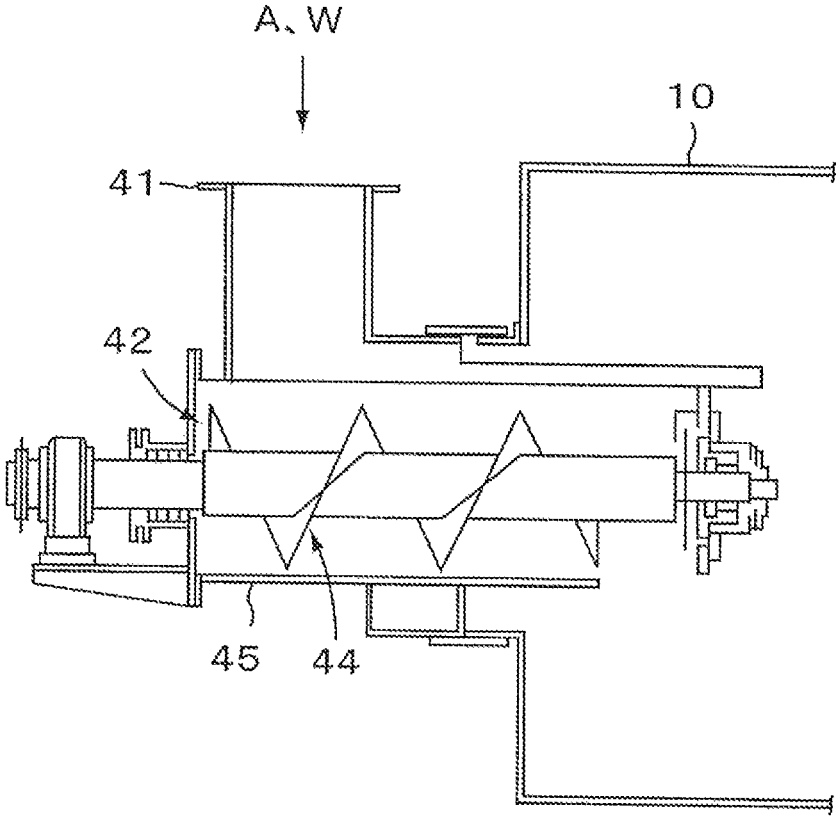
FIG. 2 is a side view illustrating a screw feeder and a periphery thereof.

Next, a process of drying the processing material W in the horizontal rotary dryer will be described while referring to FIG. 1 to FIG. 3.

The processing material W is fed into the screw feeder 42 from the feed port 41, and by turning a screw 44 disposed inside the screw feeder 42 with the use of a not-illustrated driving unit, the processing material W is fed to the inside of the rotating shell 10. The processing material W fed from the feed port 41 moves to the other end side of the rotating shell 10 while being dried by being brought into contact with the steam tubes (heating tubes) 11 heated by steam, and is discharged from discharge ports 50.

On the other hand, the carrier gas A blown from the feed port 41 by the blowing unit provided on the one end side of the rotating shell 10 passes through the inside of the rotating shell 10, and is exhausted to the outside of the rotating shell 10 from the discharge ports 50 which are also discharge ports for the processing material W.

Further, the steam fed into the heating tubes 11 from the feed pipe 70 is cooled in a process of flowing through the inside of the heating tubes 11, when the processing material W and the heating tubes 11 are brought into contact with each other to perform heat exchange, and the steam is turned into liquid D to be discharged from the drain pipe 71.

Modified Example

Next, description will be made also on a case where a horizontal rotary dryer provided with the agitating unit 65 and the classification hood 55 is used, while referring to FIG. 4 and FIG. 5. In this case, a part of description overlapped with the above description will be omitted.

When the processing material W fed into the rotating shell 10 reaches the position at which the agitating unit 65 is provided, the processing material W is agitated by the agitating unit 65, and subsequently lifted up by the lifters 60 which rotate in accordance with the rotation of the rotating shell 10, as illustrated in FIG. 5. The lifted processing material W naturally falls down when the lifters 60 are positioned on the upper side of the rotating shell 10, and at this time, fine particles C included in the processing material W are dispersed in the rotating shell 10 (so-called flight action). Note that the shape of the agitating unit 65 may employ a shape of plate projecting toward a center direction of the rotating shell 10, or the like, so that the agitating unit 65 is structured to be able to lift up the processing material W in accordance with the rotation of the rotating shell 10. For example, the agitating unit 65 may have a shape similar to that of the lifter 60.

On the other hand, the carrier gas A blown from the feed port 41 by the blowing unit provided on the one end side of the rotating shell 10 passes through the inside of the rotating shell 10, and is exhausted to the outside of the rotating shell 10 from the discharge ports 50 which also serve as outlets for the processing material W. At this time, the carrier gas A is exhausted from the discharge ports 50 while being accompanied by the fine particles C dispersed in the rotating shell 10 by the lifters 60. The carrier gas A exhausted from the discharge ports 50 is exhausted from the classification hood 55 via the fixed exhaust gas opening 56.

In the processing material W, heavy particles each having a large particle size fall down in the rotating shell 10, and naturally fall down from the discharge ports 50 positioned on a lower side, without being discharged from the fixed exhaust gas opening 56 by the carrier gas A. The particles (processing material W) which have naturally fallen down are discharged as the processed material E to the outside from the fixed outlet 57.

(Modified Example of Feed System)

A modified example of the horizontal rotary dryer according to the present invention will be described.

Figure 6:
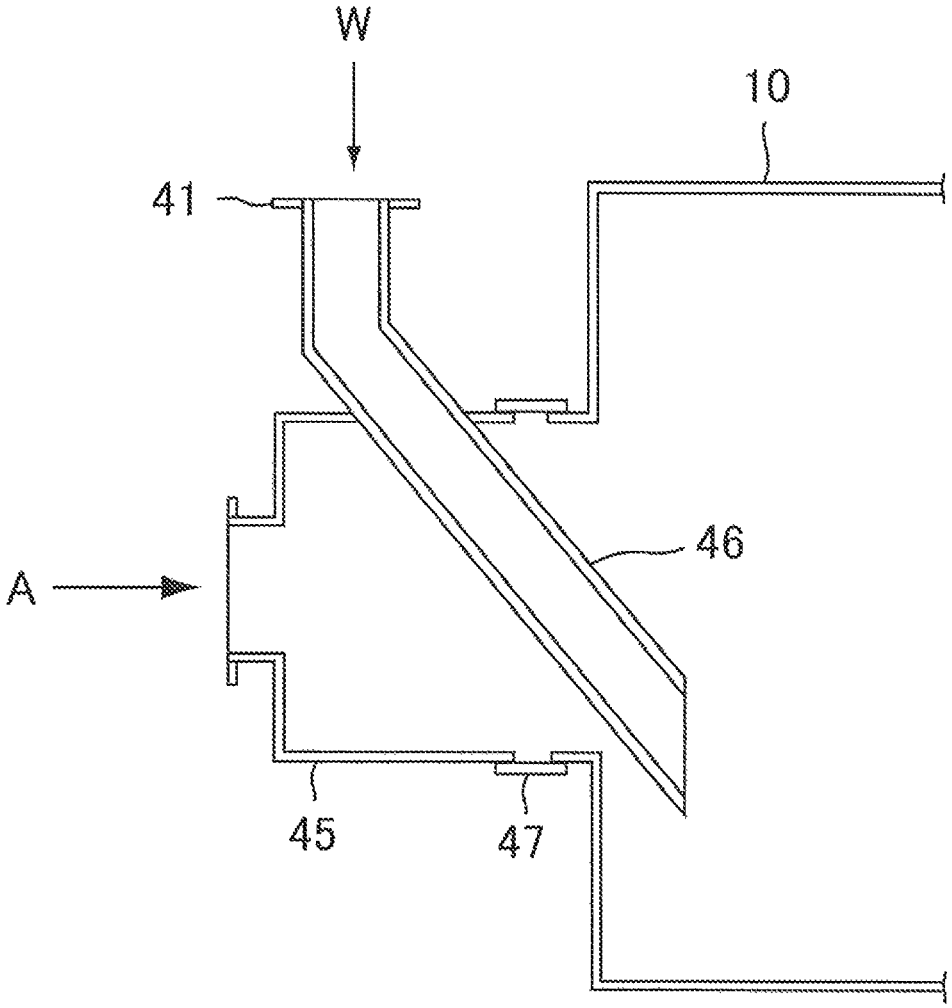
FIG. 6 is a side view illustrating a case where a feed system is one of chute type.
Figure 7:
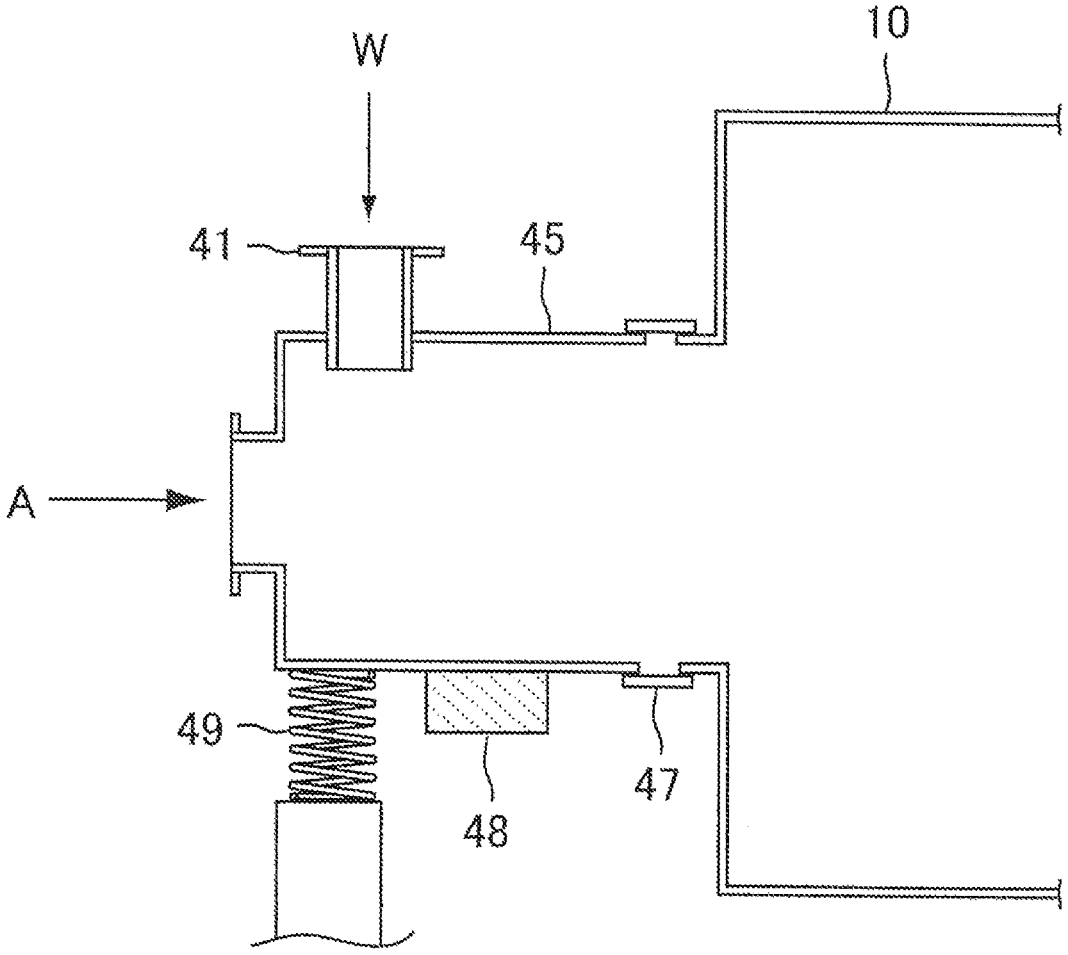
FIG. 7 is a side view illustrating a case where the feed system is one of vibration trough type.

As a system of feeding the processing material W to the horizontal rotary dryer, there can be exemplified one of, other than the aforementioned screw type (FIG. 2), a chute type (FIG. 6) or a vibration trough type (FIG. 7). In the chute type, a feed chute 46 is coupled to an intake box 45, and the processing material W fed from the feed port 41 falls in the feed chute 46 to move to the inside of the rotating shell 10. The intake box 45 is connected to the rotating shell 10 via a seal packing 47, and it is structured in a manner that the rotating shell 10 rotates while maintaining sealing between the rotating shell 10 and the intake box 45. In the vibration trough type, the intake box 45 has a trough shape (recessed cross-sectional shape), and a vibration motor 48 and a spring 49 are coupled to a lower end of the intake box 45. The processing material W fed from the feed port 41 falls on the trough. Further, when the intake box 45 is vibrated by the vibration motor 48, the processing material W moves to the inside of the rotating shell 10. It is preferable that when the intake box 45 is attached, the intake box 45 is inclined downward toward the rotating shell 10 in order to allow the easy movement of the processing material W.

(Modified Example of Rotating Shell)

Figure 8:
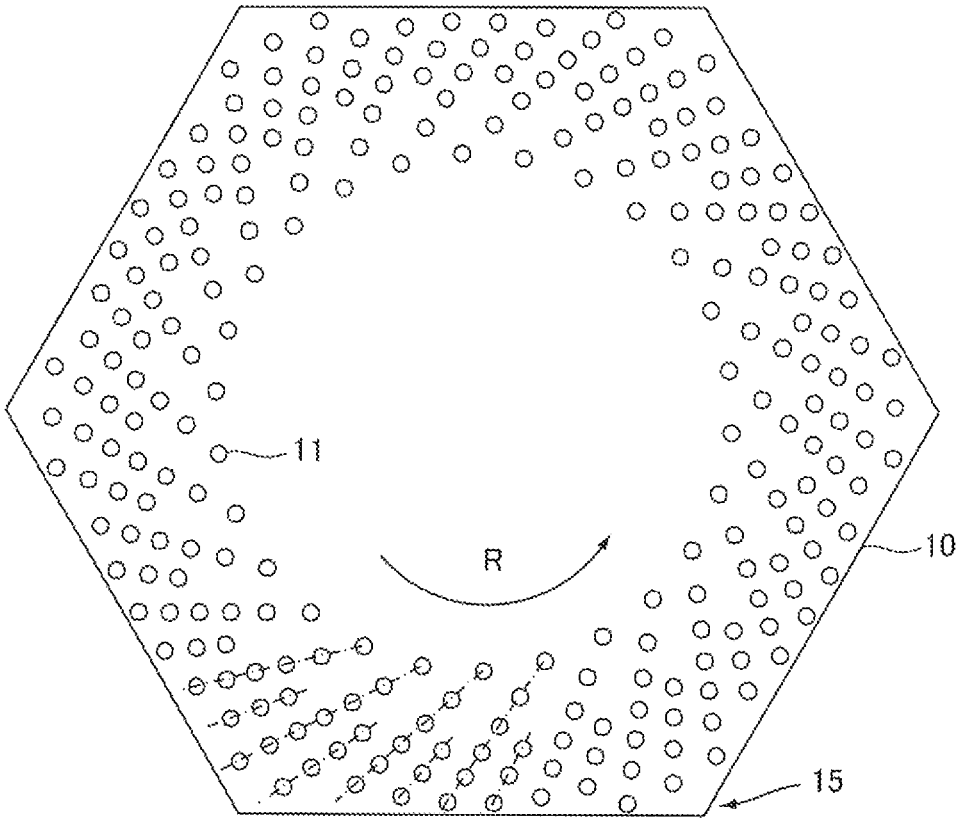
FIG. 8 illustrates an example in which a shape of a transverse section of the rotating shell is set to a rectangular shape.

The cross-sectional shape of the rotating shell 10 may be set to a rectangular shape, other than a circular shape to be described later. As an example of the rectangular shape, the rotating shell 10 in a hexagonal shape is illustrated in FIG. 8. When the rectangular rotating shell 10 is rotated, the processing material W is raised by corner portions 15 of the rotating shell 10, which realizes better mixing of the processing material W. Meanwhile, since the cross-sectional area of the rotating shell 10 becomes narrow when compared to a case where the circular rotating shell 10 is employed, there also exists a demerit such that the number of heating tubes 11 to be arranged is reduced. Note that the number of corner portions (number of sides) of the rectangular shape can be changed, and in more detail, the number of corner portions can be set to an arbitrary number of three or more.

Figure 9:
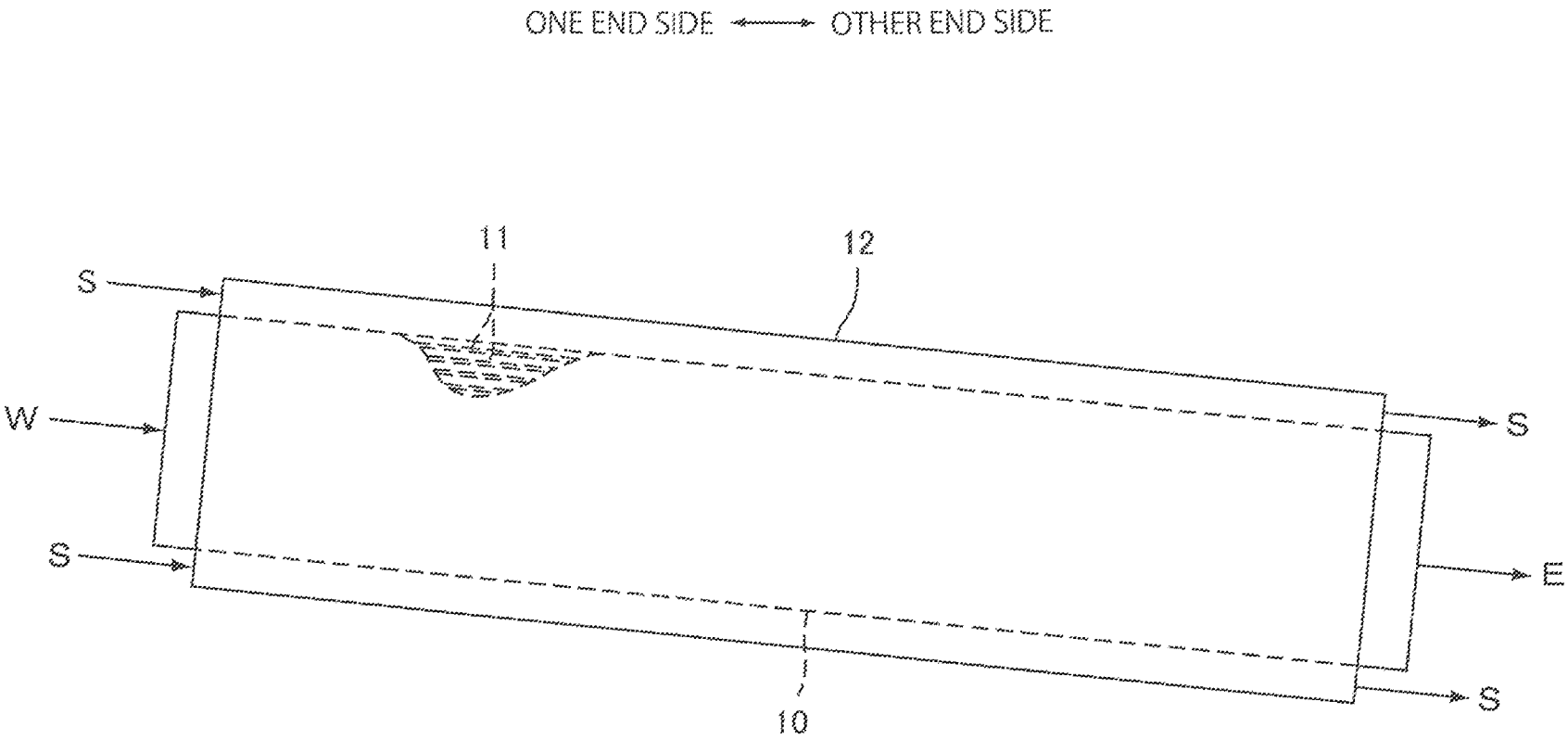
FIG. 9 is a side view illustrating a case where a jacket is provided on the outside of the rotating shell.

As illustrated in FIG. 9, it is also possible to provide a jacket 12 surrounding the rotating shell 10. In this case, a heating medium S is flowed between an outside wall of the rotating shell 10 and an inside wall of the jacket 12, to thereby perform heating also from the outside of the rotating shell 10. As a result of this, it is possible to increase the drying rate of the processing material W, when compared to a case where the jacket 12 is not provided. As an example of the heating medium S, there can be cited high temperature gas at 200° C. to 400° C., hot oil at 200° C. to 400° C., or the like. Other than the above, it is also possible to provide, instead of the jacket 12, a plurality of trace pipes (not illustrated) so as to surround the rotating shell 10.

(Modified Example of Discharge System)

Figure 10:
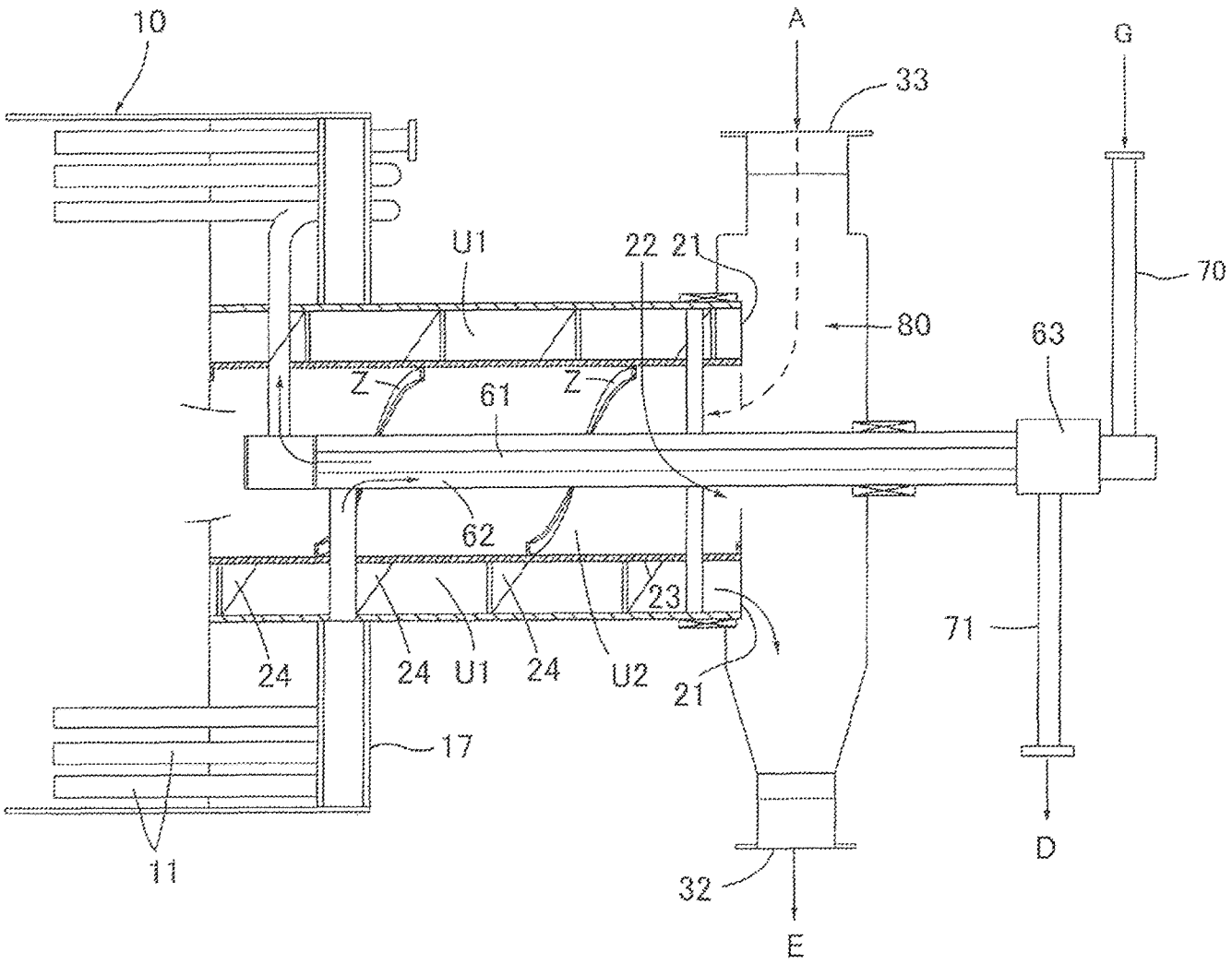
FIG. 10 is a side view illustrating a modified example of a discharge system for processed material.

As a system of discharging the processed material E from the horizontal rotary dryer, a configuration as illustrated in FIG. 10 can also be employed. In such a configuration, the carrier gas A is sent to the inside a partition wall 23 from a carrier gas feed port 33 at an upper portion of a casing 80. When the carrier gas A is reused gas, the carrier gas A contains powder dust and the like, but, since ribbon screws Z are arranged inside the partition wall 23, namely, in a gas passage U2, the power dust and the like mixed in the gas are captured by the ribbon screws Z. The captured powder dust and the like are sent toward an opening 22 because of a transfer action of the ribbon screws Z, and discharged to the inside of the casing 80. The discharged powder dust and the like freely fall to be discharged from the discharge port 32 at a lower portion of the casing. In contrast, gas as a result of removing the powder dust and the like from the carrier gas A is sent to the inside of the rotating shell 10 without being prevented by the ribbon screws Z.

Further, screw blades 24 also rotate in accordance with the rotation of the rotating shell 10. Therefore, the dried material E as a result of drying the processing material W is sent, in a delivery passage U1, toward an opening 21 because of a transfer action of the screw blades 24, and is discharged from the opening 21. The discharged dried material E is discharged, by its own weight, from the discharge port 32 at the lower portion of the discharge casing.

On the other hand, a steam path (formed of an internal steam feed pipe 61 and an internal drain discharge pipe 62) penetrating through the casing 80 and extending to the inside of the partition wall 23, is integrally provided with the rotating shell 10. The internal steam feed pipe 61 is communicated with an entrance header portion for the heating tubes 11 of an end plate part 17, and the internal drain discharge pipe 62 is communicated with an exit header portion for the heating tubes 11 of the end plate part 17. Further, a steam feed pipe 70 and a drain discharge pipe 71 are connected to the internal steam feed pipe 61 and the internal drain discharge pipe 62, respectively, via a rotary joint 63.

(Modified Example of Gas Distribution System)

Each of the horizontal rotary dryers in FIG. 1 and FIG. 4 employs "cocurrent flow" in which the direction in which the processing material W moves and the direction in which the carrier gas A flows are the same. Other than the above, it is also possible to employ "countercurrent flow" in which the direction in which the processing material W moves and the direction in which the carrier gas A flows are opposite.

Figure 11:
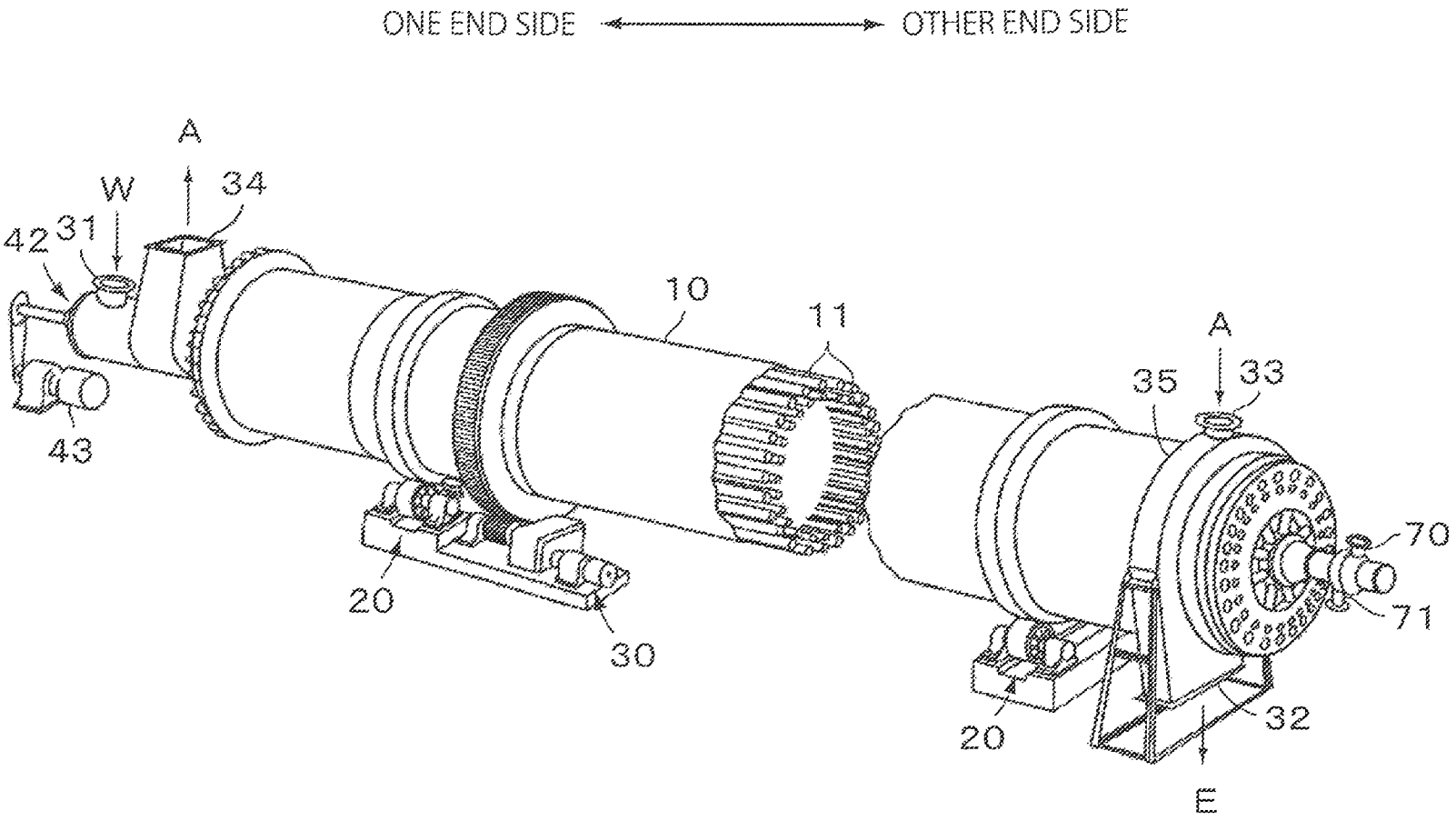
FIG. 11 is a perspective view of a horizontal rotary dryer employing countercurrent flow.

One example of a horizontal rotary dryer employing the "countercurrent flow" is illustrated in FIG. 11. This horizontal rotary dryer has a feed port 31 for the processing material W provided above a screw feeder 42, and has a discharge port 32 for the processed material E provided at a lower end of a hood 35. Further, the processing material W is fed from the feed port 31 to be moved from one end side to the other end side of the rotating shell 10, the processing material W is heated to be dried by the heating tubes 11 through the movement process, and the dried processed material E is discharged from the discharge port 32. Meanwhile, a feed port 33 for the carrier gas A is provided at an upper end of the hood 35, and a discharge port 34 for the carrier gas A is provided above the screw feeder 42. Further, the carrier gas A is fed from the feed port 33, and flowed from the other end side to the one end side of the rotating shell 10, the carrier gas conveys steam evaporated from the processing material W during a process of the flow, and the carrier gas A accompanied by the steam is discharged from the discharge port 34.

10, the carrier gas conveys steam evaporated from the processing material W during a process of the flow, and the carrier gas A accompanied by the steam is discharged from the discharge port 34.

Figure 12B:
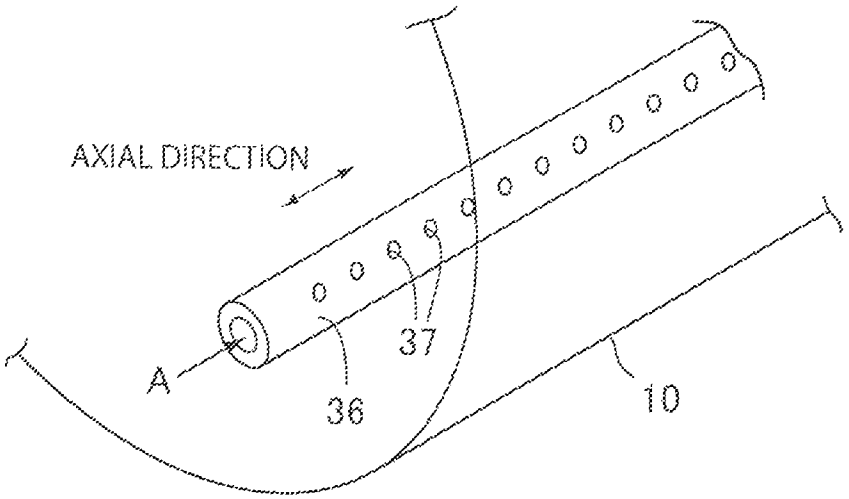
FIGS. 12(*a*) and 12(*b*) are explanatory diagrams of a horizontal rotary dryer of a type employing a gas blowing pipe, in which FIG. 12(*a*) is a sectional view of the gas blowing pipe, and FIG. 12(*b*) is a perspective view in which the gas blowing pipe is arranged in the dryer.
Figure 12A:
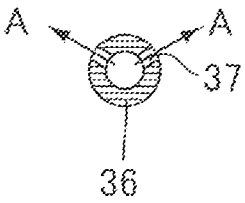

Other than the above, it is also possible to use a horizontal rotary dryer of a type employing a gas blowing pipe, as illustrated in FIG. 12. A gas blowing pipe 36 is provided inside the rotating shell 10 to extend in the axial direction, and rotates together with the rotating shell 10 and the heating tubes 11. For example, the gas blowing pipe 36 can be provided between the plurality of heating tubes 11, 11, or at a position further on the inner side relative to the heating tubes 11 positioned on the innermost side. Note that in FIG. 12, the illustration of the heating tubes 11 is omitted, for easier understanding of the gas blowing pipe 36. On a wall surface of the gas blowing pipe 36, a plurality of gas blowout openings 37 are opened. In the example of FIG. 12, the gas blowing openings 37 are provided in two lines in an axial direction, at upper portions of the gas blowing pipe 36.

When the above-described dryer of the type employing the gas blowing pipe is operated, the carrier gas A is fed into the gas blowing pipe 36 from the other end side of the rotating shell 10. The fed carrier gas A is blown out into the rotating shell 10 from the gas blowing openings 37, and flows out from the one end side of the rotating shell 10 while being accompanied by the steam generated from the processing material W. Other than the above, it is also possible to employ a configuration in which the carrier gas A is fed into the gas blowing pipe 36 from the one end side of the rotating shell 10, and the gas is exhausted from the other end side of the rotating shell 10.

(Modified Example of Rotating Shell Supporting Structure)

Other than the above, the supporting structure of the rotating shell 10 may also employ, other than the aforementioned supporting structure in which two tire members 20, 20 are attached to the outer periphery of the rotating shell 10, a structure in which bearings (not illustrated) are attached to outer peripheries of a screw casing 42 provided on one end side and the gas pipe 72 provided on the other end side, and the bearings are supported, or a supporting structure realized by combining the tire members 25 and the bearings.

(Rotation Speed)

In the present invention, the rotating shell 10 is rotated at a speed faster than that in the conventional horizontal rotary dryer, in order to increase the drying rate of the processing material W. A method of deciding the rotation speed will be described hereinafter.

(Process 1)

A processing load PL of the horizontal rotary dryer is decided. Concretely, the load PL is calculated based on a type of the processing material W, the water content (%), a targeted processing amount (kg/h), and the like.

(Process 2)

A small-sized horizontal rotary dryer is used as an experimental machine, to examine a drying rate Rd per unit load.

(Process 3)

A size of the rotating shell 10 is decided based on the drying rate Rd examined in the process 2.

(Process 4)

A number of rotations of the rotating shell 10 is decided. A conventional method of deciding the number of rotations uses, as an important criterion, a rotation speed of the rotating shell 10 (in the present invention, "rotation speed"

is also referred to as "circumferential speed"), and concretely, the number of rotations has been decided by using the following expression 5. Note that a value of rotation speed V has been decided based on empirical rule within a range of about 0.1 to 1 [m/s].

$$N=(V\times 60)/(D\times\pi) \quad \text{Expression 5}$$

Here, N indicates the number of rotations (r.p.m.), V indicates the rotation speed (m/s), and D indicates an inside diameter (in) of the rotating shell 10.

In the present invention, the number of rotations is decided based on, not the aforementioned expression 5, but a critical speed ratio, and concretely, the number of rotations is decided by using the following expression 6, $$N=V/Vc\times Nc \quad \text{Expression 6}$$

wherein N indicates the number of rotations (r.p.m.), V indicates the rotation speed (m/s), Vc indicates a critical speed (m/s), and Nc indicates a critical number of rotations (r.p.m.).

(Critical Speed, Critical Speed Ratio)

Figure 13:
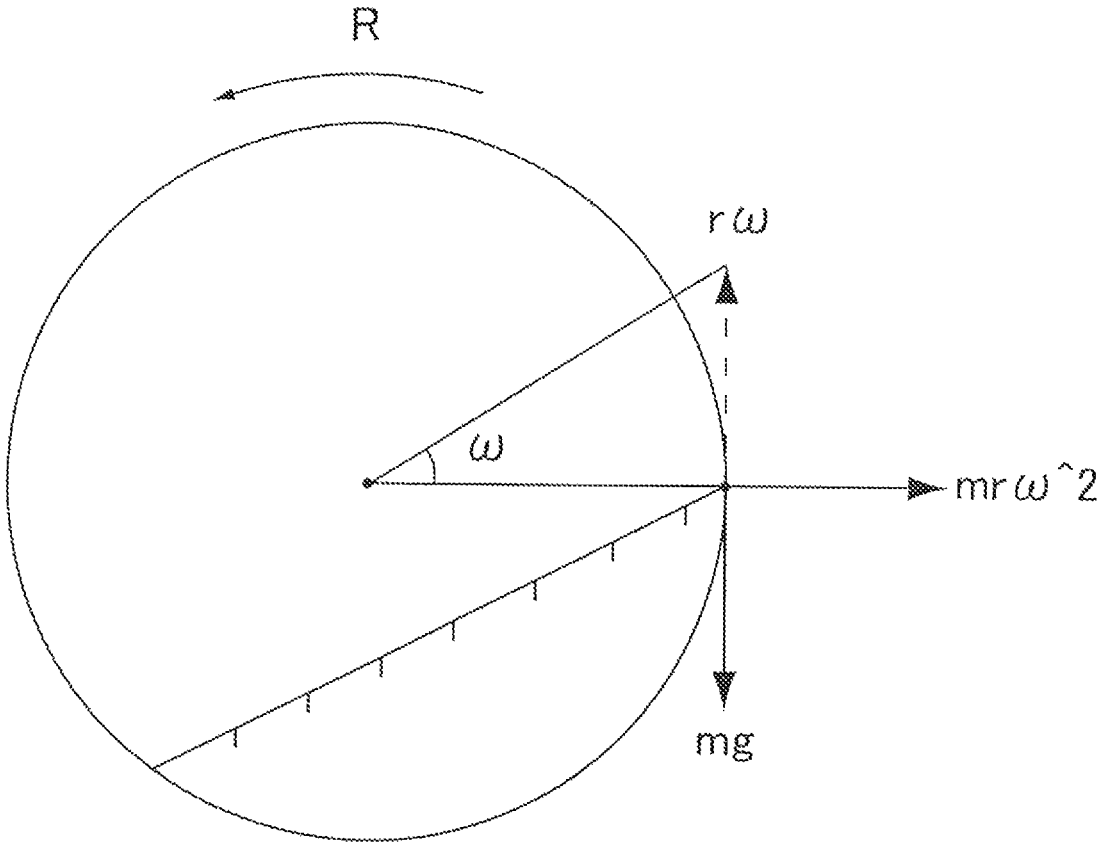
FIG. 13 is an explanatory diagram illustrating a process of deriving a critical speed ratio.

The "critical speed" and the "critical number of rotations" in the aforementioned expression 6 will be described in detail. When FIG. 13 is referred to, the "critical speed" corresponds to a rotation speed at which gravity of the processing material W and centrifugal force acted on the processing material W are balanced in the horizontal rotary dryer, and theoretically indicates a rotation speed of the rotating shell 10 when the processing material W corotates with the rotating shell 10. Note that no indicates a speed. Further, the "critical speed ratio" indicates a ratio of the actual rotation speed to the critical speed.

(Critical Speed)

The critical speed will be described in detail. At the critical speed, the gravity (mg) of the processing material W and the centrifugal force ($mr\omega^2$) are the same, so that the following expression 7 is satisfied, $$mg=mr\omega^2 \quad \text{Expression 7}$$

wherein in indicates mass (kg) of the processing material W, g indicates a gravitational acceleration ($m/s^2$), r indicates a radius (in) of the rotating shell 10, and ω indicates an angular speed (rad/s).

Further, the following expression 8 can be derived from the aforementioned expression 7, $$g=r(Vc/r)^2 \quad \text{Expression 8}$$

wherein g indicates the gravitational acceleration ($m/s^2$), r indicates the radius (in) of the rotating shell 10, and Vc indicates the critical speed (m/s).

Therefore, it is possible to derive the following expression 1 from the aforementioned expression 8, to thereby determine the critical speed (m/s), $$Vc=(rg)^{1/2}=(D/2\cdot g)^{1/2}=2.21D^{1/2}$$

$$Vc=2.21D^{1/2} \quad \text{Expression 1}$$

wherein Vc indicates the critical speed (m/s), and D indicates the inside diameter (in) of the rotating shell 10.

(Critical Speed Ratio)

Next, the critical speed ratio will be described. The critical speed ratio α indicates the ratio of the actual rotation speed V to the critical speed (Vc), and thus it can be represented by the following expression 2, $$\alpha=V/Vc\cdot 100 \quad \text{Expression 2}$$

wherein α indicates the critical speed ratio (%), V indicates the rotation speed (m/s), and Vc indicates the critical speed (m/s).

(Critical Number of Rotations)

Note that the number of rotations of the rotating shell 10 at the critical speed is referred to as "critical number of rotations", and can be determined through the following expression 9, $$Nc=Vc\cdot 60/(\pi D)=2.21D^{1/2}\cdot 60/(\pi D)=42.2/D^{1/2}$$

$$Nc=42.2/D^{1/2} \quad \text{Expression 9}$$

wherein Nc indicates the critical number of rotations (r.p.m.), Vc indicates the critical speed (m/s), and D indicates the inside diameter (in) of the rotating shell 10.

(Scale-Up)

Figure 14:
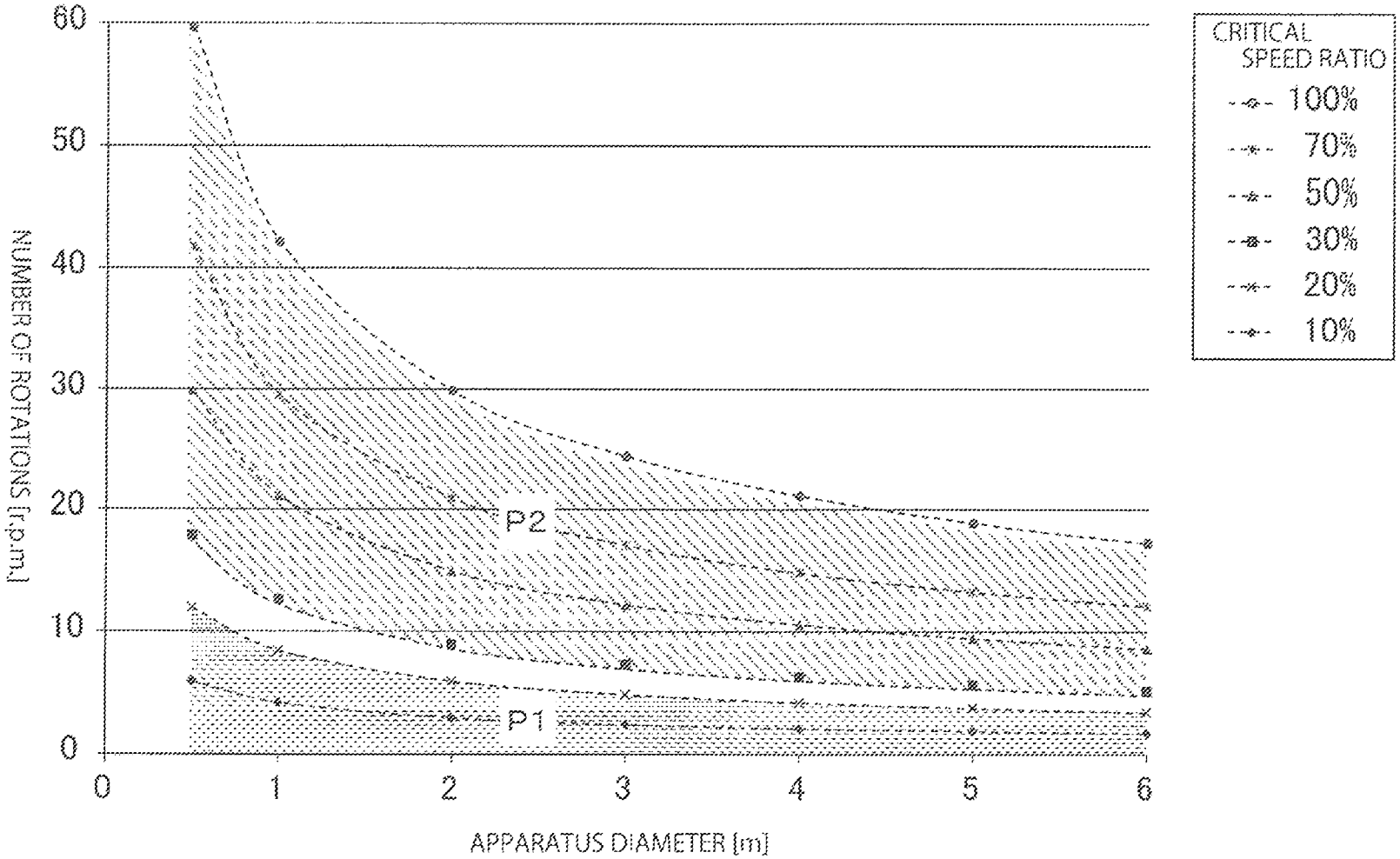
FIG. 14 is a graph illustrating a relationship among a diameter of a rotating shell, a number of rotations, and a critical speed ratio.

FIG. 14 illustrates a change in the critical speed ratio α (%) in which X-axis represents the inside diameter D (in) of the rotating shell 10, and Y-axis represents the number of rotations N (r.p.m.). P1 indicates a number of rotations of a conventional rotating shell 10, and P2 indicates a number of rotations of the rotating shell 10 of the present invention. According to FIG. 14, it can be clearly recognized, at a glance, that the operating condition of the present invention (critical speed ratio α=30 to less than 100%) is different from the operating condition of the conventional example.

Experimental Example 1

Three horizontal rotary dryers with different inside diameters were used to perform an experiment regarding a relationship between the critical speed ratio α (%) and the drying rate Rd. The diameters of the rotating shells 10 of the respective STDs are 320 mm, 900 mm, and 1830 mm. Further, a gap K between the heating tubes 11 arranged in each of the rotating shells 10 is 100 mm.

Coal (processing material W) was charged in each of the STDs in a batch manner. A charging amount of the coal with respect to the STD with the diameter of 320 mm is 4 kg, a charging amount of the coal with respect to the STD with the diameter of 900 mm is 50 kg, and a charging amount of the coal with respect to the STD with the diameter of 1830 mm is 250 kg. Further, the median diameter of the coal is 2.2 mm Note that a pressure of steam which is flowed in the heating tubes 11 arranged in each of the rotating shells 10 was set to 0.6 MPa (gage pressure).

Figure 15:
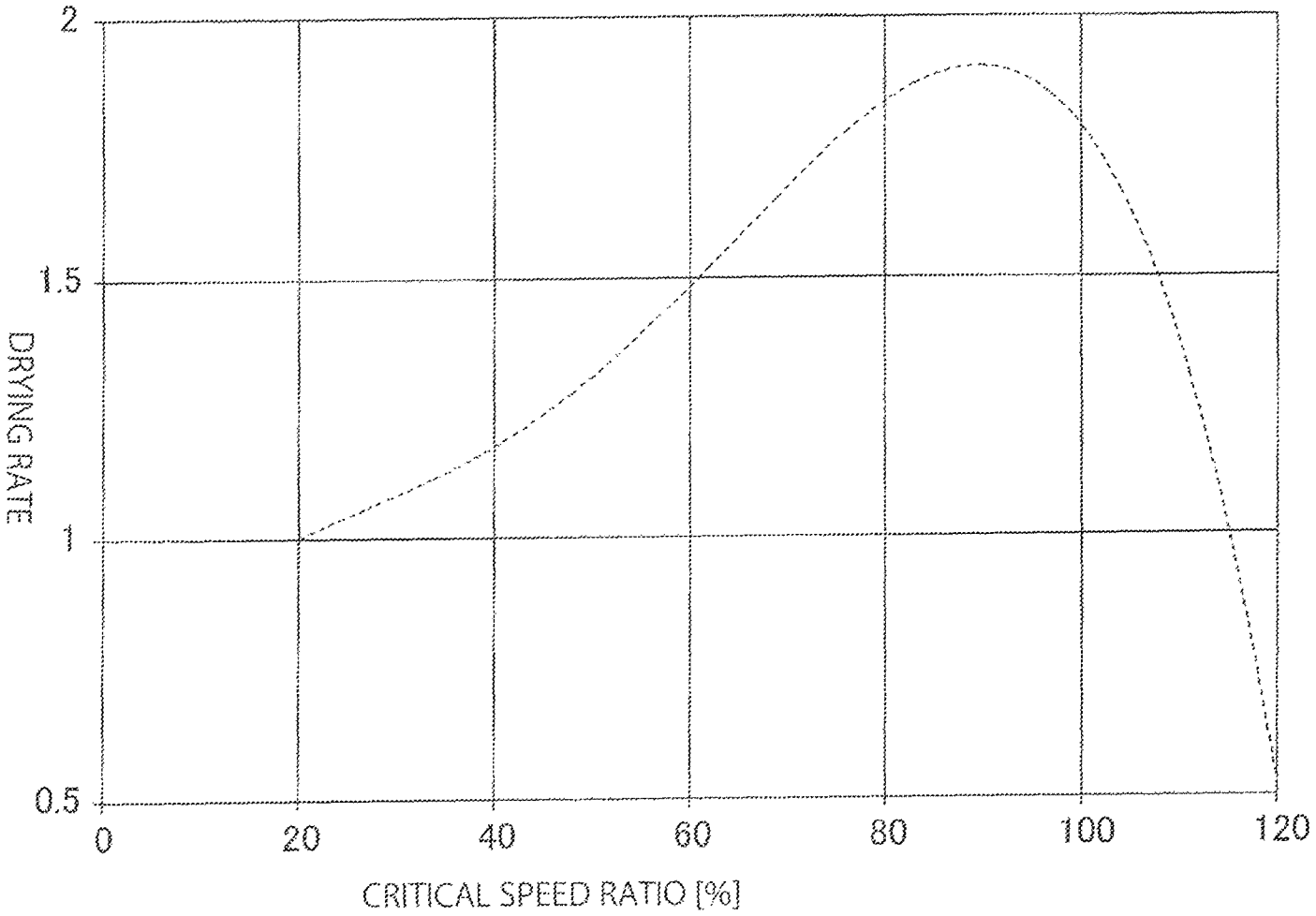
FIG. 15 is a graph illustrating a relationship between the critical speed ratio and a drying rate when a diameter of the rotating shell is 320 mm.

FIG. 15 is a graph illustrating a relationship between the critical speed ratio and the drying rate when the diameter of the rotating shell 10 of the STD is 320 mm Values of the drying rate in FIG. 15 are relative numeric values. In detail, a value of the drying rate when the diameter of the rotating shell 10 of the STD is 320 mm, and the critical speed ratio is 20% is defined as 1, and the values of the drying rate are represented by relative numeric values based on the value of 1.

Figure 16:
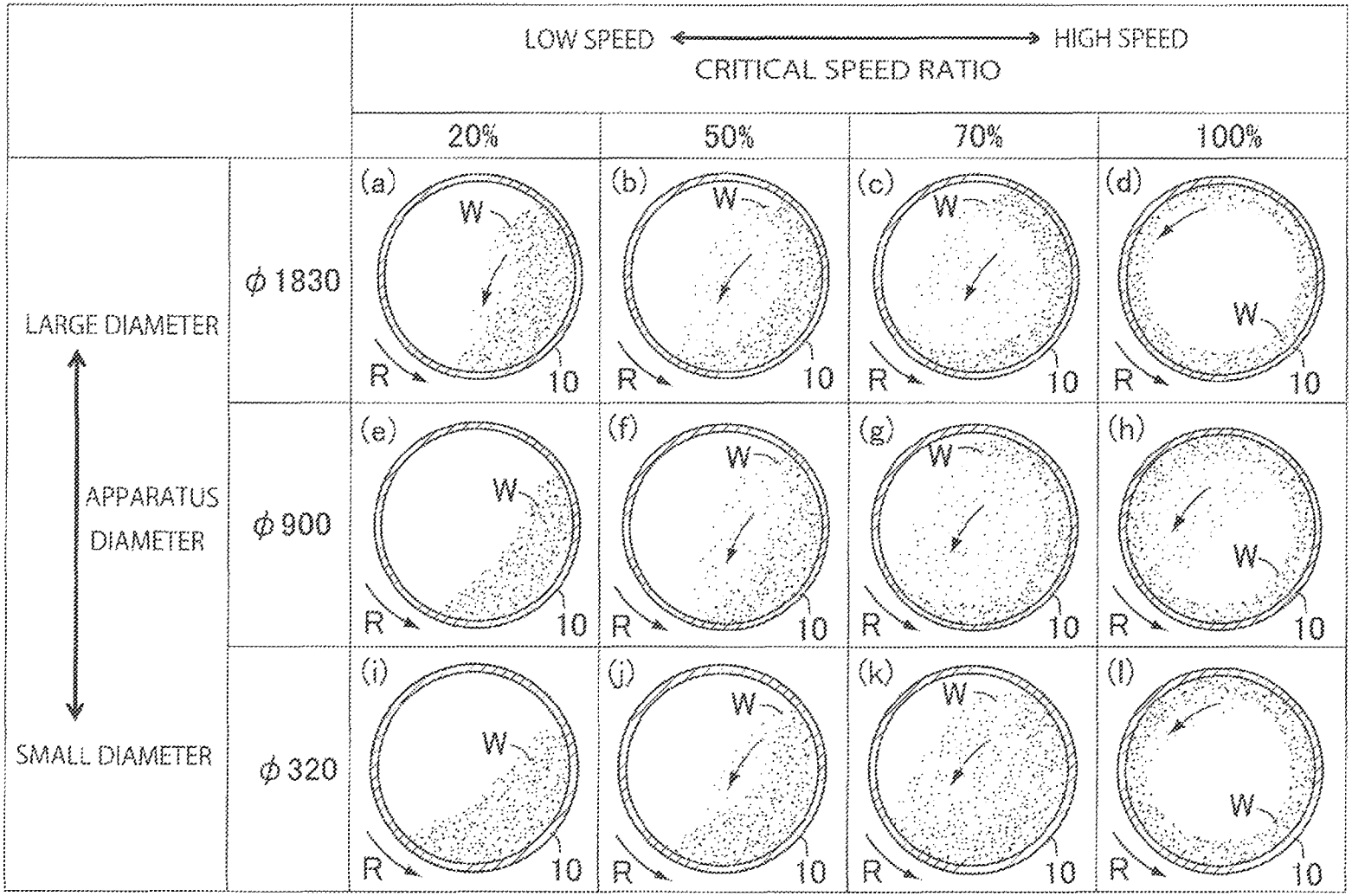
FIG. 16 is a diagram obtained in a manner that a rotating shell is operated while arbitrarily changing the critical speed ratio and a diameter of the rotating shell, dispersion states of processing material in the inner part of the rotating shell are photographed, and the photographs are traced.

Further, a diagram obtained in a manner that the rotating shell 10 was operated while arbitrarily changing the critical speed ratio and the diameter of the rotating shell 10, dispersion states of the processing material W in the inner part of the rotating shell 10 were photographed, and the photographs were traced, is illustrated in FIG. 16. Specifically, a transparent plate was provided at a transverse section of each of the horizontal rotary dryers so that behavior of the processing material W could be visually recognized, the dispersion states of the processing material W in the inner part of the rotating shell 10 were photographed through this transparent plate, and the photographs were traced. Note that the rotational direction of the rotating shell 10 in FIG. 16 is counterclockwise, in a similar manner to FIG. 5.

When the operation was performed by setting the critical speed ratio to 20%, the processing material W is subjected to kiln action in a region of right side of the rotating shell 10. However, the processing material W remains, in an aggregated state, on an inside wall of the rotating shell 10, and thus a movement amount thereof is small, so that the processing material W is not dispersed very much. This means that the heat transfer surface of the rotating shell 10 and the processing material W (coal) are not sufficiently brought into contact with each other.

On the other hand, when the inner part of the rotating shell 10 was checked at the time of performing operation by setting the critical speed ratio to 50%, it was confirmed that the processing material W was dispersed in a wide range in the rotating shell 10. Further, when the operation was performed by increasing the critical speed ratio to 70%, and the inner part of the rotating shell 10 was checked, the processing material W was dispersed in a wider range.

Further, when the inner part of the rotating shell 10 was checked at the time of performing operation by setting the critical speed ratio to 100%, it was confirmed that, although a slight amount of the processing material W fell from the middle, almost all of the processing material W was subjected to corotation, and thus the heat transfer surface and the processing material W were not brought into contact with each other and no heat transfer was conducted.

Note that an arrow mark illustrated in the rotating shell 10 in FIG. 16 indicates a direction in which the processing material W falls.

Figure 17:
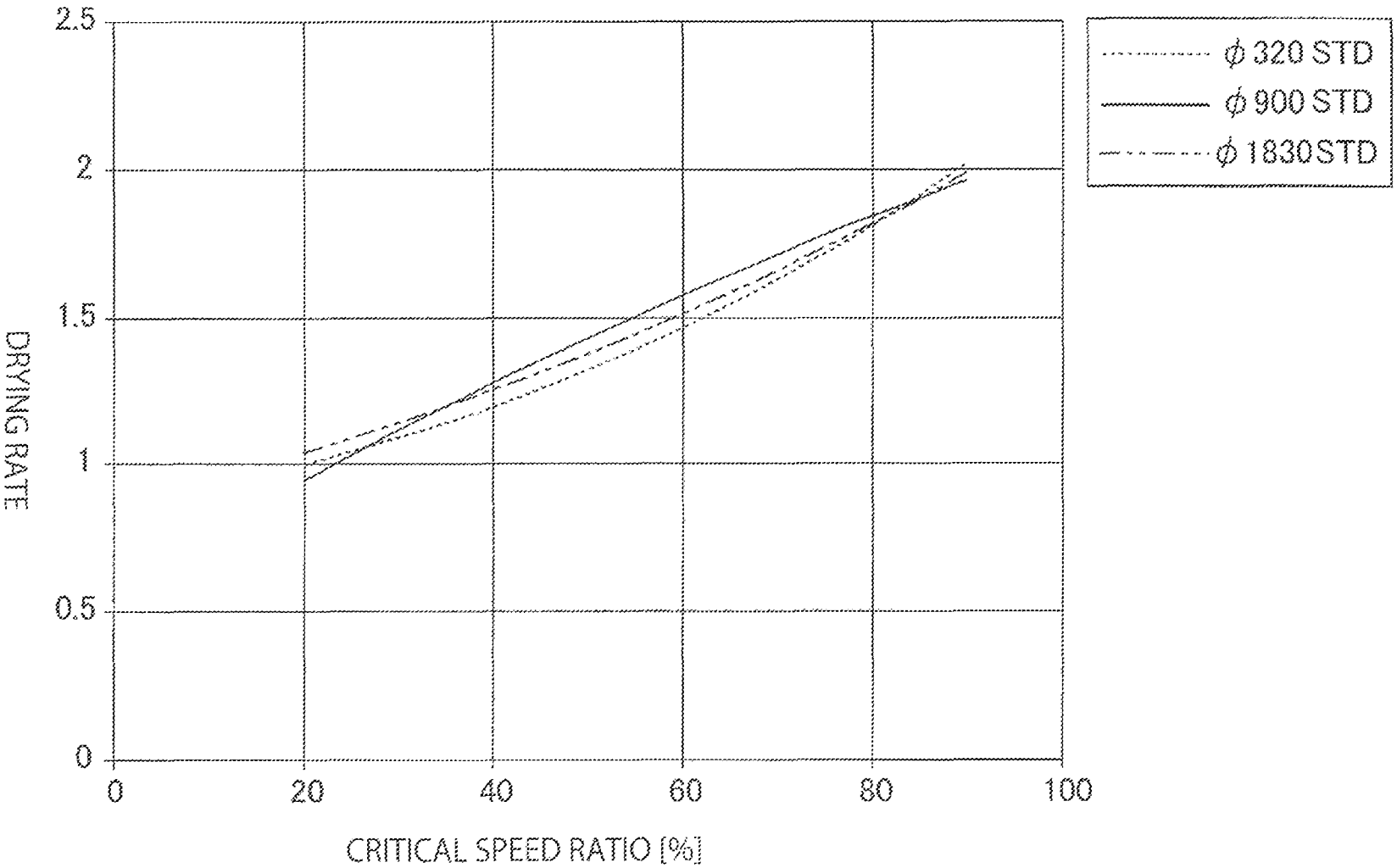
FIG. 17 is a graph illustrating a relationship between the critical speed ratio and the drying rate when the diameter of the rotating shell is changed.

Actually, it was confirmed that the drying rate increases as the critical speed ratio increases, as illustrated in FIG. 17. Further, even if the diameter of the rotating shell 10 changes, there is no change in the upward tendency of the drying rate with respect to the critical speed ratio. Note that values of the drying rate in FIG. 17 are relative numeric values. In detail, a value of the drying rate when the diameter of the rotating shell 10 of the STD is 320 mm, and the critical speed ratio is 20% is defined as 1, and the values of the drying rate are represented by relative numeric values based on the value of 1.

(Hold Up Ratio)

In the present invention, when the rotating shell 10 is rotated at a high speed, it is preferable to set the hold up ratio of the processing material W to 20 to 40%. The hold up ratio is preferably set to 25 to 30%.

Note that the hold up ratio can be determined by the following expression 3, $$\eta = Ap/Af \cdot 100 \qquad \text{Expression 3}$$

wherein η indicates the hold up ratio (%), Ap indicates a cross-sectional area ($m^2$) occupied by the processing material W with respect to a free cross-sectional area, and Af indicates a free cross-sectional area ($m^2$) as a result of subtracting a cross-sectional area of all of the heating tubes from the entire cross-sectional area of the rotating shell 10.

Experimental Example 2

An experiment was conducted by charging coal (processing material W) into a STD with a diameter of 450 mm at 200 kg/h. The gap K between the heating tubes 11 arranged in the rotating shell 10 is 100 mm. Further, the median diameter of the coal is 2.2 mm Note that a pressure of steam which is flowed in the heating tubes 11 arranged in the rotating shell 10 was set to 0.6 MPa (gage pressure).

Figure 18:
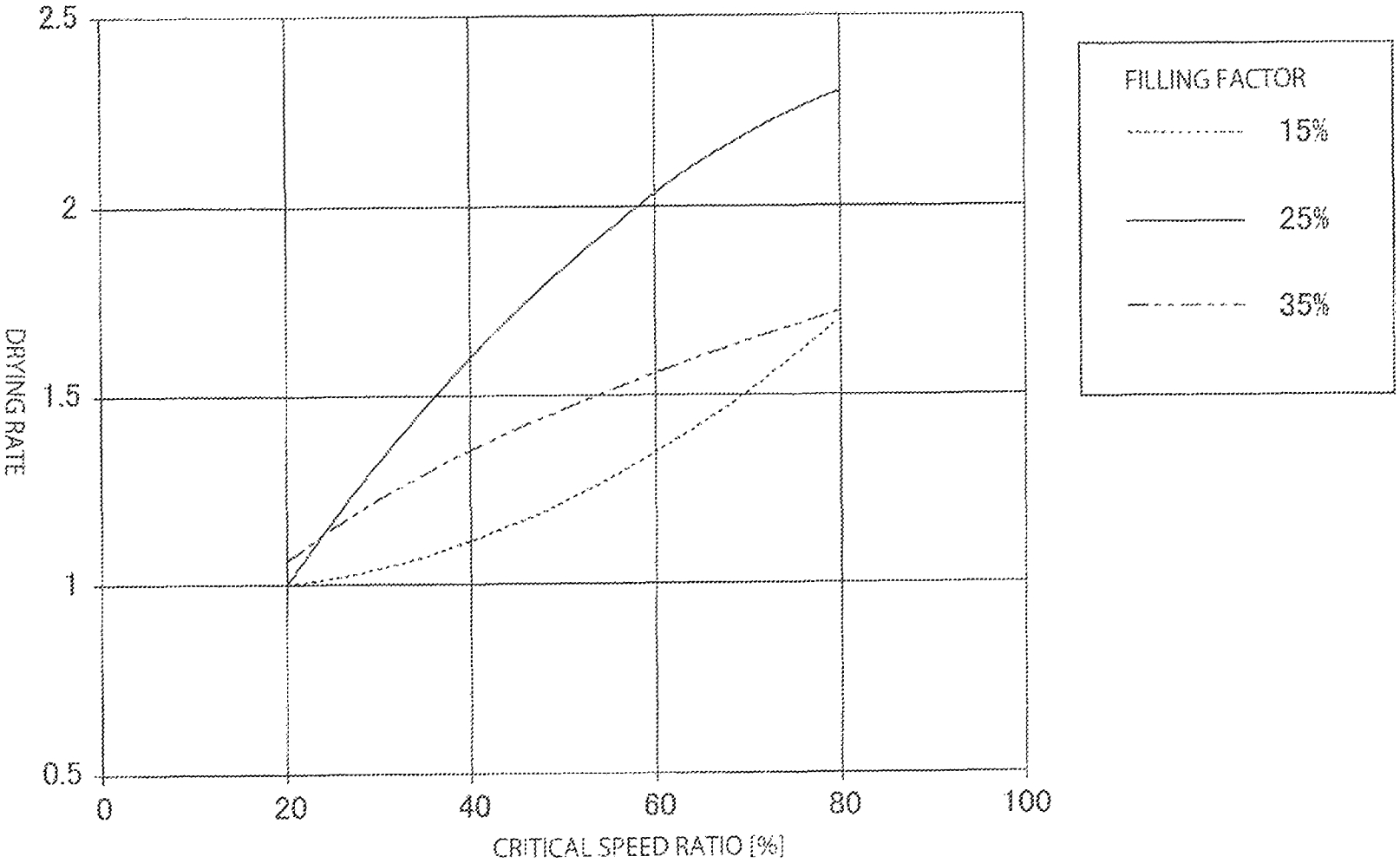
FIG. 18 is a graph illustrating a relationship between the critical speed ratio and the drying rate when a hold up ratio is changed.

FIG. 18 is a graph illustrating the critical speed ratio and the drying rate when the hold up ratio is changed. Values of the drying rate in FIG. 18 are relative numeric values. In detail, a value of the drying rate when the hold up ratio is 15% and the critical speed ratio is 20% is defined as 1, and the values of the drying rate are represented by relative numeric values based on the value of 1. When operation was performed by setting the hold up ratio of the processing material W to 15%, the contact area between the processing material W and the heating tubes 11 was small, so that the drying rate was not increased. On the other hand, when operation was performed by setting the hold up ratio of the processing material W to 25%, the contact area between the processing material W and the heating tubes 11 was increased, and the drying rate was increased. Further, when operation was performed by setting the hold up ratio of the processing material W to 35%, slip occurred at an upper layer of powder layer (layer of processing material W in powder form), and the number of processing material W which was not brought into contact with the heat transfer surface increased. As a result of this, when compared to the case where the operation was performed with the hold up ratio of 25%, the drying rate was not increased. However, the drying rate was faster than that when the operation was performed with the hold up ratio of 15%. Note that even if any one of the hold up ratios was employed, as the critical speed ratio was increased, the drying rate increased.

Through the above-described experiment, it was confirmed that it is preferable to employ the hold up ratio of 20 to 40% by which the drying rate of the processing material W significantly increases.

(Gap Between Heating Tubes 11)

Figure 19:
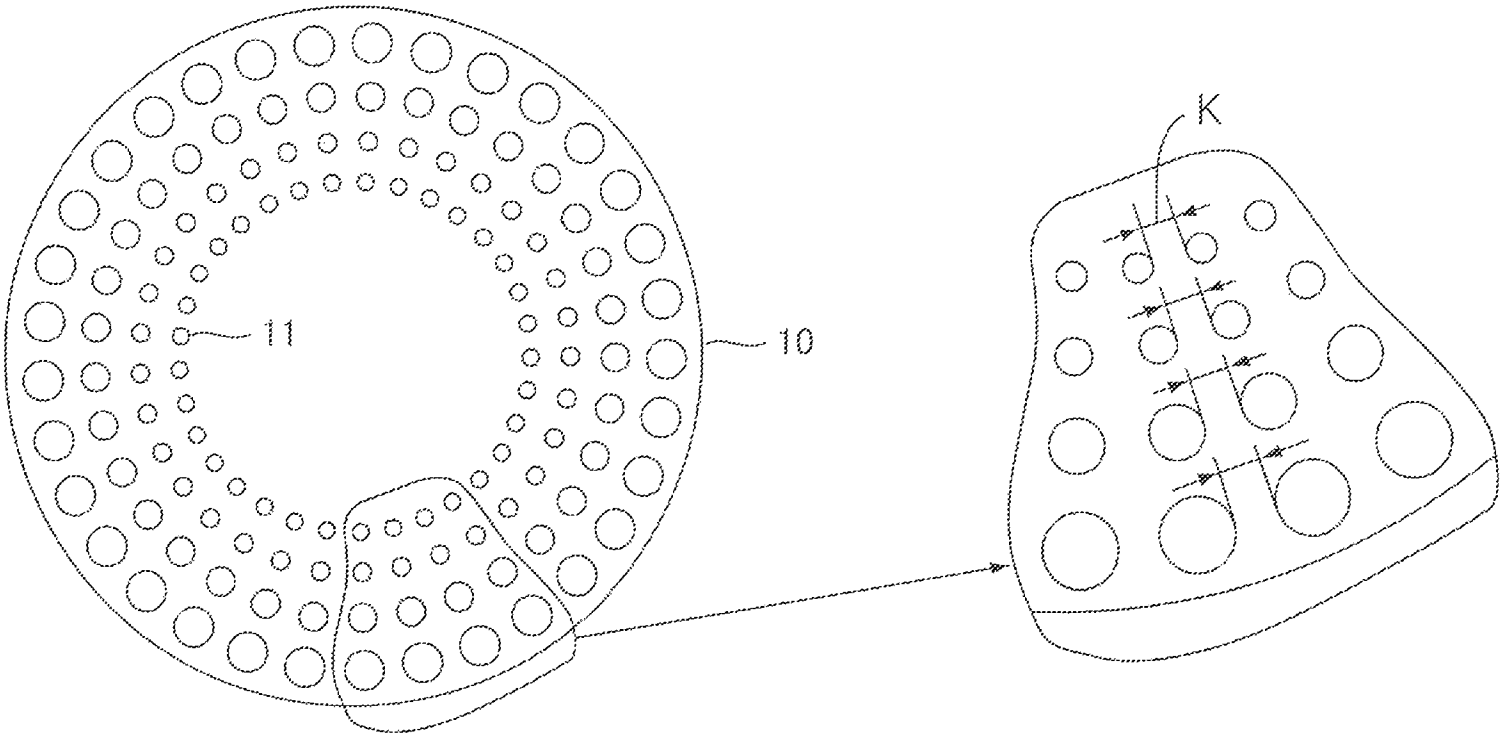
FIG. 19 is an explanatory diagram of a gap between heating tubes of the horizontal rotary dryer according to the present invention.

FIG. 19 illustrates the gap K between the heating tubes 11. In this example, the gap K is the same among four lines of concentric circles. For this reason, the diameter of the heating tube 11 is increased toward the outside. A distance between the adjacent heating tubes 11 (gap) K is preferably set to 80 to 150 mm. It is of course possible to perform appropriate modification such that the heating tubes 11 are set to have the same diameter, or the gap K is increased toward the outside, for example. Further, it is also possible to employ a later-described first arrangement form or second arrangement form.

Experimental Example 3

An experiment was conducted by charging 250 kg of coal (processing material W) into a STD with a diameter of 1830 mm in a batch manner. The median diameter of the coal is 2.2 mm Note that a pressure of steam which is flowed in the heating tubes 11 arranged in the rotating shell 10 was set to 0.6 MPa (gage pressure).

Figure 20:
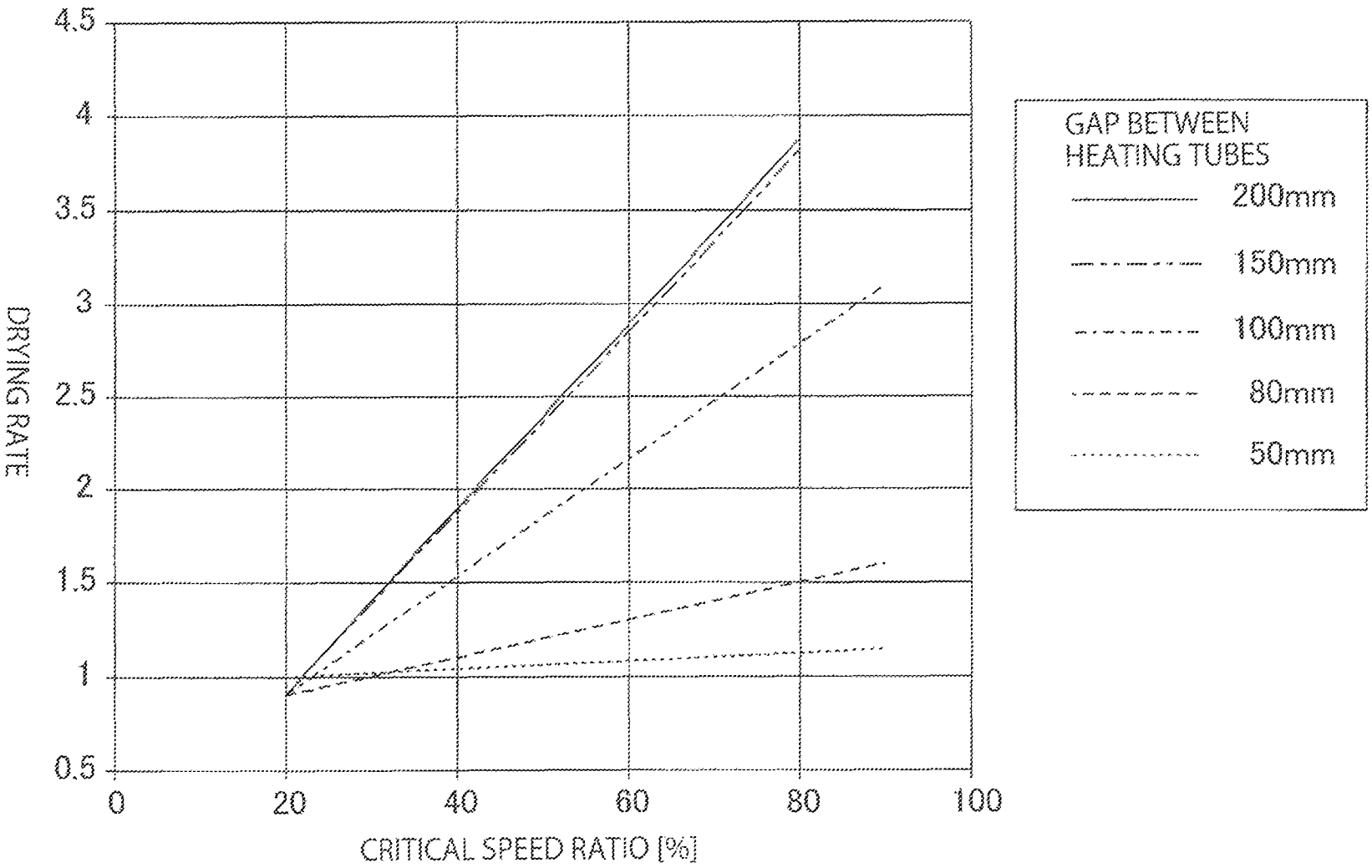
FIG. 20 is a graph illustrating a relationship between the critical speed ratio and the drying rate when a length of the gap between the heating tubes is changed (processing material:coal)

FIG. 20 is a graph illustrating the critical speed ratio and the drying rate. Values of the drying rate in FIG. 20 are relative numeric values. In detail, a value of the drying rate when the gap K between the heating tubes 11 is 50 mm, and the critical speed ratio is 20%, is defined as 1, and the values of the drying rate are represented by relative numeric values based on the value of 1.

Further, the arrangement of the heating tubes 11 when creating the graph in FIG. 20 was similar to that of FIG. 19. Specifically, the heating tubes 11 were arranged in a radial manner from a center of the rotating shell 10 toward the outside, and the diameters of the heating tubes 11 were gradually increased from the inside toward the outside. Accordingly, all of the gaps K between the heating tubes 11 positioned on the first column to the n-th column are set to be the same. For example, when the gap K between the heating tubes 11 is 50 mm, each of all of the gaps K between the heating tubes 11 positioned on the first column to the n-th column is 50 mm Note that this arrangement of the heating tubes 11 is similarly employed also in later-described FIG. 21.

When operation was performed by setting the gap K between the heating tubes 11 to 50 mm, an amount of the processing material W flowing through the gap K was small, and the processing material W was not mixed very much, resulting in that the drying rate was slow. Thereafter, as the gap K between the heating tubes 11 was increased to 80 mm, 100 mm, and 150 mm, the drying rate became gradually fast. It can be estimated that a part of the reason thereof is that the amount of the processing material W flowing through the gap K becomes gradually large, and thus the mixing of the processing material W favorably occurs. On the other hand, when operation was performed by setting the gap K between the heating tubes 11 to 200 mm, an amount of the processing material W flowing through the gap K was increased. However, when compared to the case where the length of the gap K was 150 mm, the contact area between the processing material W and the heating tubes 11 was not changed very much. As a result of this, the drying rate was not so different from the drying rate when the gap K was 150 mm Note that at any hold up ratio, as the critical speed ratio was increased, the drying rate increased.

Through the above-described experiment, it was confirmed that the distance (gap) between the adjacent heating tubes 11 is preferably set to 80 to 150 mm.

Experimental Example 4 (Resin-Based Material)

A resin-based material was charged into a STD with a diameter of 1830 mm in a batch manner. A charging amount of the resin-based material is 250 kg. Further, the median diameter of the resin-based material is 0.1 mm Further, a pressure of steam which is flowed in the heating tubes 11 in the rotating shell 10 was set to 0.45 MPa (gage pressure).

Figure 21:
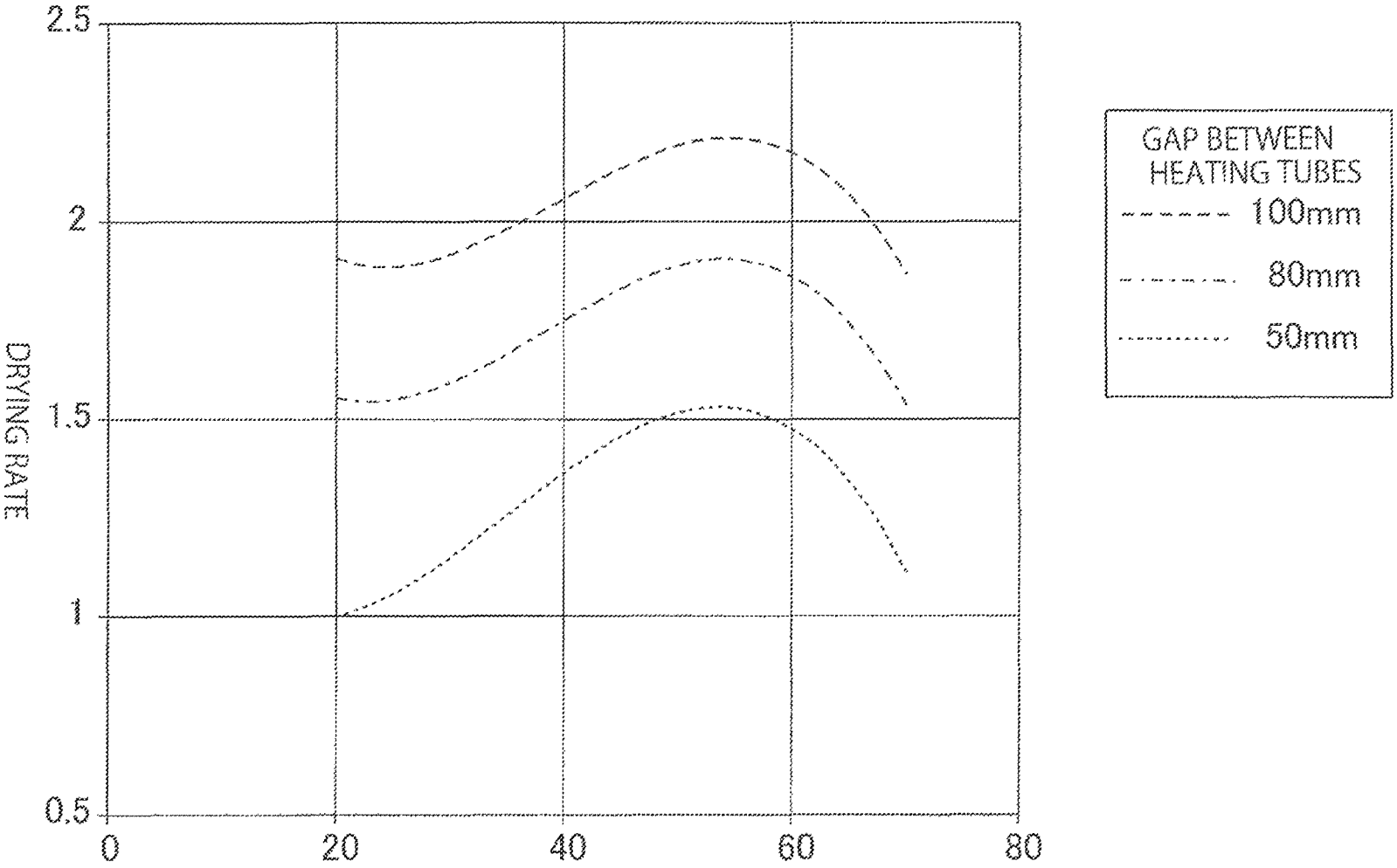
FIG. 21 is a graph illustrating a relationship between the critical speed ratio and the drying rate when the length of the gap between the heating tubes is changed (processing material:resin-based material)

FIG. 21 is a graph illustrating a relationship between the critical speed ratio and the drying rate when the length of the gap K between the heating tubes 11 is changed by using the resin-based material as the processing material W. Values of the drying rate in FIG. 21 are relative numeric values. In detail, a value of the drying rate when the gap K between the heating tubes 11 is 50 mm, and the critical speed ratio is 20% is defined as 1, and the values of the drying rate are represented by relative numeric values based on the value of 1.

As illustrated in FIG. 21, the drying rates form a shape of mountain in which peaks thereof appear when the critical speed ratio $\alpha$ is around 50%. Therefore, it can be understood that the critical speed ratio $\alpha$ of 30 to 70% is preferable. Further, when the gap K between the heating tubes 11 is gradually increased to 50 mm, 80 mm, and 100 mm, the drying rate also becomes gradually fast.

As can be predicted also from the above results, it is preferable to employ the critical speed ratio of 40 to 90%, although the optimum critical speed ratio differs depending on the type and the water content of the processing material W, the size of the dryer, and the like.

(Relationship Between Outside Diameter and Inside Diameter)

In the above-described respective descriptions and respective expressions, the inside diameter D of the rotating shell 10 is used, and the outside diameter is not used. However, it is also possible to use the outside diameter by correcting the above-described respective expressions. This point will be described hereinafter in detail.

In the above-described respective expressions, D indicates the inside diameter, and a correcting expression for using, not the inside diameter, but the outside diameter, will be described. When the outside diameter of the rotating shell 10 is set to Do, the plate thickness (wall thickness) of the rotating shell 10 is set to t, and the inside diameter is set to D, a relationship among these is represented by the following expression 10.

$$D=Do-(2\times t) \qquad \text{Expression 10}$$

Therefore, it is only required to substitute the right side in the expression 10 into D in the above-described respective expressions. For example, the expression regarding the critical speed ratio can be described as follows.

$$Vc=2.21D^{1/2}$$

$$Vc=2.21\times(Do-2\times t)^{1/2} \qquad \text{Expression 1}$$

Note that as a reference, a general numeric value of the wall thickness t of the rotating shell 10 of the STD or the like will be described. As the size of the rotating shell 10 becomes large, the wall thickness t tends to increase in order to maintain strength of the rotating shell, and actually, the wall thickness t is designed to have approximately the following numeric value. When the inside diameter D of the rotating shell 10 is 0.3 to 6 in, the wall thickness t becomes 3 to 100 mm.

<Regarding Heating Tube>

Although the size and the arrangement of the heating tubes 11 can be appropriately selected in the present invention, in order to increase mainly the contact efficiency to thereby increase the drying rate in the process of realizing the high-speed rotation aimed by the present inventors, it was found out that measurements to be described next are effective.

(Arrangement of Heating Tubes)

Figure 29:
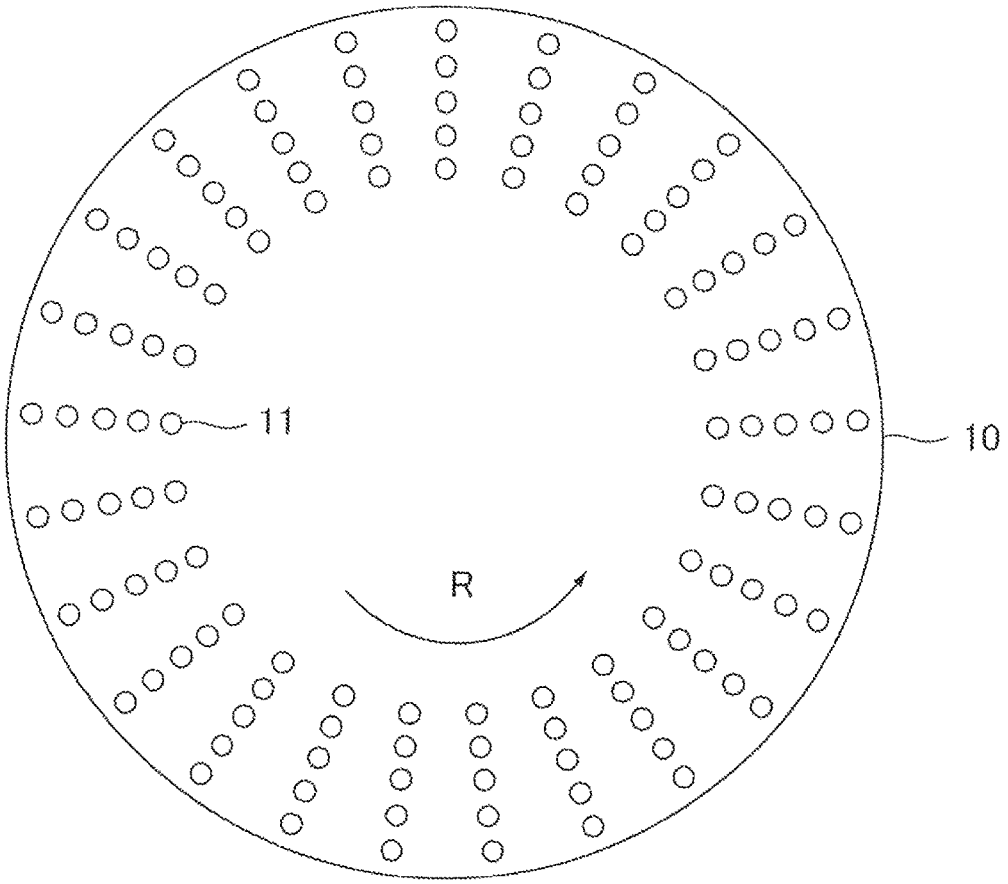
FIG. 29 is a transverse sectional view illustrating an example of arrangement of heating tubes of a conventional horizontal rotary dryer.

Conventionally, the heating tubes 11 have been arranged in a radial manner in the rotating shell 10, as illustrated in FIG. 29. In the rotating shell 10, the processing material W (granular material) enters gaps between the plurality of heating tubes 11 moved to a lower part of the rotating shell 10, and lifted up in the rotational direction by the plurality of heating tubes 11 in accordance with the rotation of the rotating shell 10. The processing material W lifted up to its repose angle starts to fall mainly at a point of time of exceeding the repose angle, and is subjected to falling motion. In more detail, the processing material W falls, like a snowslide, from portions between the plurality of heating tubes 11 at upper positions exceeding the limit of the repose angle, and collides with the heating tubes 11 positioned at the lower part of the rotating shell 10.

The fallen processing material W enters again the gaps between the plurality of heating tubes 11, 11 at the lower part of the rotating shell 10. It was clarified that, since an angle at which the processing material W falls and an angle at which the processing material W enters the gap between the heating tubes 11, 11 are different, the processing material W does not immediately enter the gap between the heating tubes 11, 11, and remains on the outside of the heating tubes 11, 11 (center side of the rotating shell 10), resulting in that the contact efficiency between the processing material W and the heating tube 11 is poor. If the contact efficiency is poor, there was a problem that the drying rate of the processing material W is lowered.

Further, since the direction in which the processing material W falls and the direction in which the processing material W enters between the plurality of heating tubes 11, 11 are different, there was a problem that the fallen processing material W collides with the heating tubes 11, 11 on the innermost column (column on the side closest to the center of the rotating shell 10), and kinetic energy once becomes zero (kinetic energy is reset).

The present invention improved the arrangement of the heating tubes 11 in order to solve the above-described problems.

Specifically, in the horizontal rotary dryer provided with: the rotating shell 10 having the feed port for processing material W on one end side thereof and the discharge port for processing material W on the other end side thereof, and capable of freely rotating around the axial center; and the large number of heating tubes 11, 11 . . . through which the heating medium passes, provided within the rotating shell 10, and heating and drying the processing material W by using the heating tubes 11, 11 . . . in the process of feeding the processing material W to the one end side of the rotating shell 10 and discharging the processing material W from the other end side of the rotating shell 10, the arrangement of the heating tubes 11, 11 . . . desirably employs the following arrangement forms.

The group of the heating tubes 11, 11 . . . is arranged substantially in a concentric form around the center of the rotating shell 10, and a connecting line connecting from a core of a first reference heating tube S1 on the center-side circle to a core of a second reference heating tube S2, is selected from one of the following (1) and (2) arrangement forms, and an arrangement form as a result of combining these (1) and (2) arrangement forms.

Figure 24:
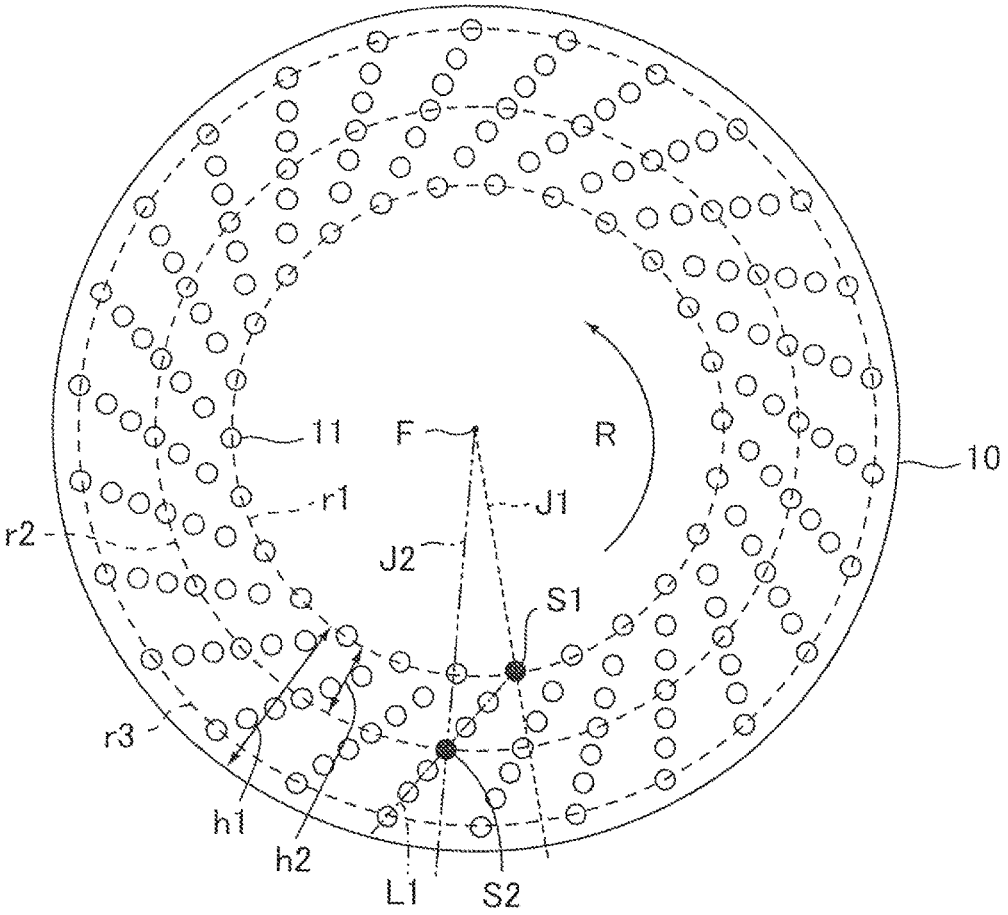
FIG. 24 is a transverse sectional view illustrating an example of arrangement of the heating tubes of the horizontal rotary dryer according to the present invention.

<With Reference to FIG. 24: Form in Shape of Diagonal Straight Line>

(1) First arrangement form in which cores of the respective heating tubes 11, 11 . . . are positioned on a straight line L1 directly connecting the core of the first reference heating tube S1 and the core of the second reference heating tube S2, and further, the core of the second reference heating tube S2 is positioned rearward in the rotational direction of the rotating shell 10 with respect to a radial line J1 passing through the core of the first reference heating tube S1.

Figure 22:
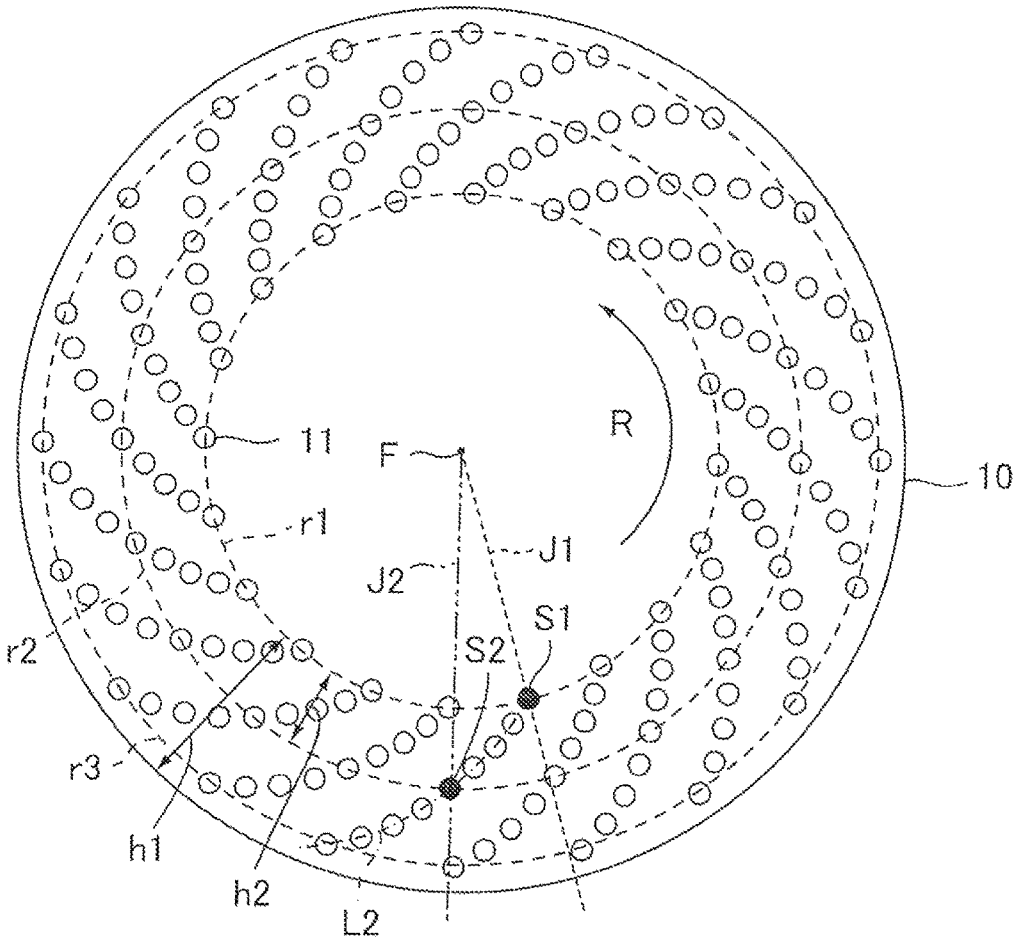
FIG. 22 is a transverse sectional view illustrating an example of arrangement of the heating tubes of the horizontal rotary dryer according to the present invention.

<With Reference to FIG. 22: Form in Shape of Curved Line>

(2) Second arrangement form in which cores of the respective heating tubes 11, 11 . . . are positioned on a curved line L2 connecting the core of the first reference heating tube S1 and the core of the second reference heating tube S2, and positioned further on the rear side in the rotational direction of the rotating shell 10 as they direct toward the core of the second reference heating tube S2, and further, the core of the second reference heating tube S2 is positioned rearward in the rotational direction of the rotating shell 10 with respect to a radial line J1 passing through the core of the first reference heating tube S1.

Specifically, as illustrated in FIG. 22 and FIG. 24, the heating tubes 11, 11 . . . are arranged in the concentric form around a center F of the rotating shell 10, and are arranged on respective concentric circles including a concentric circle r1 being a center-side circle on which the first reference heating tube S1 is positioned, a concentric circle r2 on which the second reference heating tube S2 is positioned, and a concentric circle r3 on which the outermost heating tubes 11 positioned on the outermost side of the rotating shell 10 is positioned.

Figure 23:
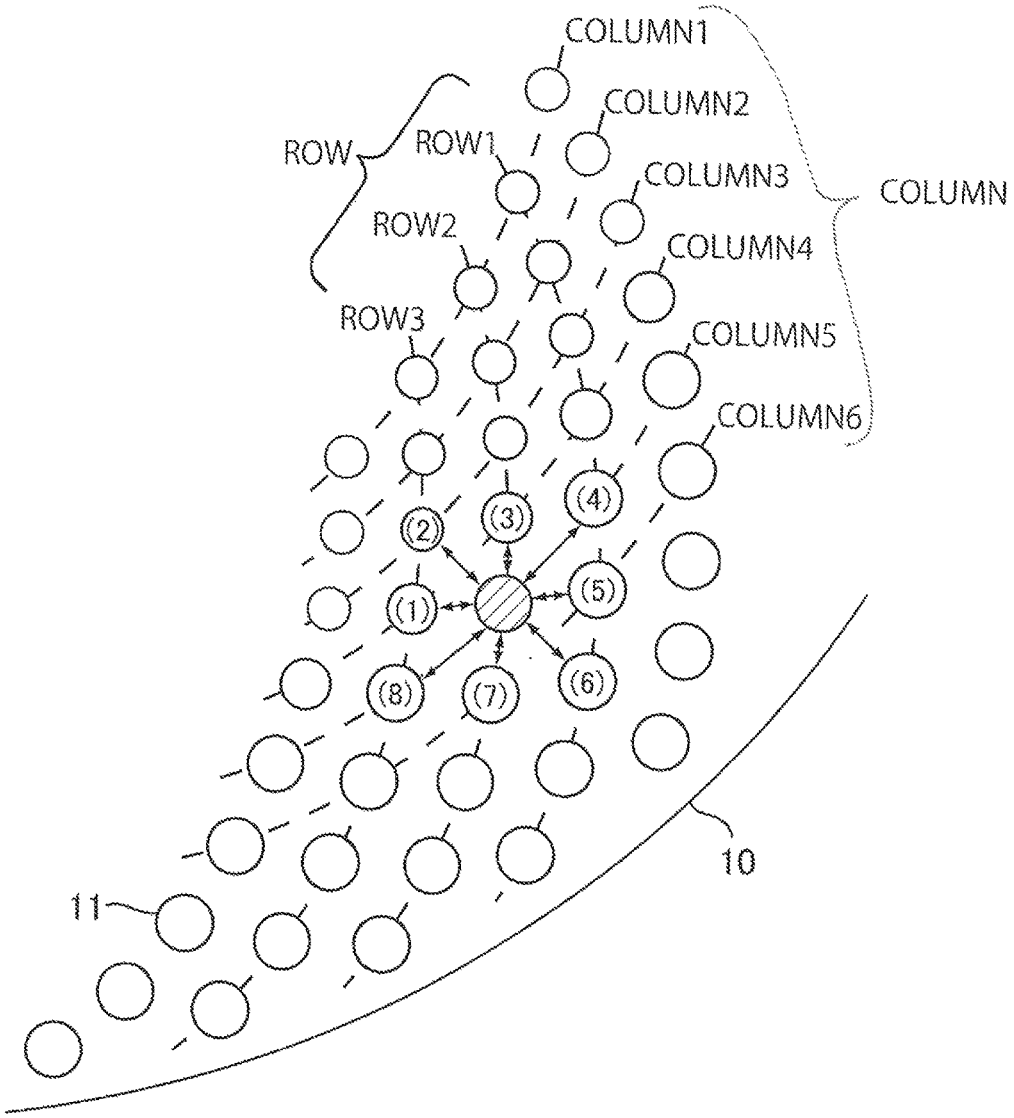
FIG. 23 is an explanatory diagram regarding a method of deciding arrangement of the heating tubes.

The core of the first reference heating tube S1 (refer to FIG. 22 and FIG. 24) corresponds to a core of the heating tube 11 (center of the heating tube) which is arbitrarily selected from a column of the group of the heating tubes 11 positioned on the side closest to the center of the rotating shell 10 ("column 1": refer to FIG. 23).

Further, the core of the second reference heating tube S2 indicates a core of the heating tube S2 (center of the heating tube 11) on a desired column number, in "columns" of the plurality of heating tubes 11, 11 . . . (refer to FIG. 23), counted from the heating tube 11 positioned on the side closest to the center of the rotating shell 10 (the first reference heating tube S1) toward the outside along the same "row".

A position of the core of the second reference heating tube S2 can be appropriately selected in accordance with a flow behavior of the processing material W (this flow behavior depends on a factor derived from physical properties (shape, size, viscosity, type of material, and the like) of the processing material W, a factor derived from operating conditions of the dryer, and the like).

At this time, an arrangement ratio $\epsilon$=h2 (from the concentric circle r2 on which the second reference heating tube S2 is positioned to the concentric circle r1 on which the first reference (innermost) heating tube S1 is positioned)/h1 (from an inner surface of the rotating shell to the concentric circle r1 on which the first reference (innermost) heating tube S1 is positioned), is desirably set to greater than ½.

Further, in the present invention, at least a section from the first reference heating tube S1 to the second reference heating tube S2 desirably employs arrangement of heating tubes of the aforementioned first arrangement form or second arrangement form.

Further, the present invention also includes a case where the position of the core of the second reference heating tube S2 is on the concentric circle r3 on which the outermost heating tubes 11 are positioned.

As described above, the region which employs the first arrangement form or the second arrangement form can be appropriately selected, and in the example illustrated in FIG. 24, the total number of columns of the heating tubes 11 is seven, and the core of the second reference heating tube S2 is positioned on the fourth column.

FIG. 24 illustrates the example of the first arrangement form, and FIG. 22 and FIG. 23 illustrate the example of the second arrangement form.

FIG. 24 illustrates the example in which all of the seven columns employ the first arrangement form. Specifically, the cores of the respective heating tubes 11, 11 . . . are positioned on the straight line L1 directly connecting the core of the first reference heating tube S1 and the core of the second reference heating tube S2, and further, the core of the second reference heating tube S2 is positioned rearward in the rotational direction of the rotating shell 10 with respect to the radial line J1 passing through the core of the first reference heating tube S1.

FIG. 22 and FIG. 23 illustrate the example in which all of nine columns employ the second arrangement form. Specifically, the cores of the respective heating tubes 11, 11 . . . are positioned on the curved line L2 connecting the core of the first reference heating tube S1 and the core of the second reference heating tube S2, and positioned further on the rear side in the rotational direction of the rotating shell 10 as they direct toward the core of the second reference heating tube S2, and further, the core of the second reference heating tube S2 is positioned rearward in the rotational direction of the rotating shell 10 with respect to the radial line J1 passing through the core of the first reference heating tube S1.

Note that in FIG. 22 and FIG. 24, a line passing through the core of the first reference heating tube S1 and a line passing through the core of the second reference heating tube S2, by setting the center point F of the rotating shell 10 as a starting point, are indicated as the radial line J1 and a radial line J2, respectively. The respective distances of h1 and h2 described above may be determined from a distance on the radial line J2.

(Another Arrangement in Shape of Curved Line or Straight Line of Heating Tubes)

Other than the above, in another preferred embodiment of the present invention, it is also possible to employ an arrangement in which the gap between the adjacent heating tubes 11 is increased from the center side toward the outside on the concentric circles around the rotation axis of the rotating shell 10. FIG. 22 to FIG. 24 illustrate examples in which the gap between the adjacent heating tubes 11 is gradually increased from the center side toward the outside.

Further, as the curved line L2 connecting the core of the first reference heating tube S1 and the core of the second reference heating tube S2, it is possible to employ a cycloid (line drawn by a particle when the particle falls at the fastest speed), the Cornu's spiral (line drawn by a particle when the particle smoothly falls), a logarithmic curve, an arc line, a line approximated to these lines, or the like.

Figure 28:
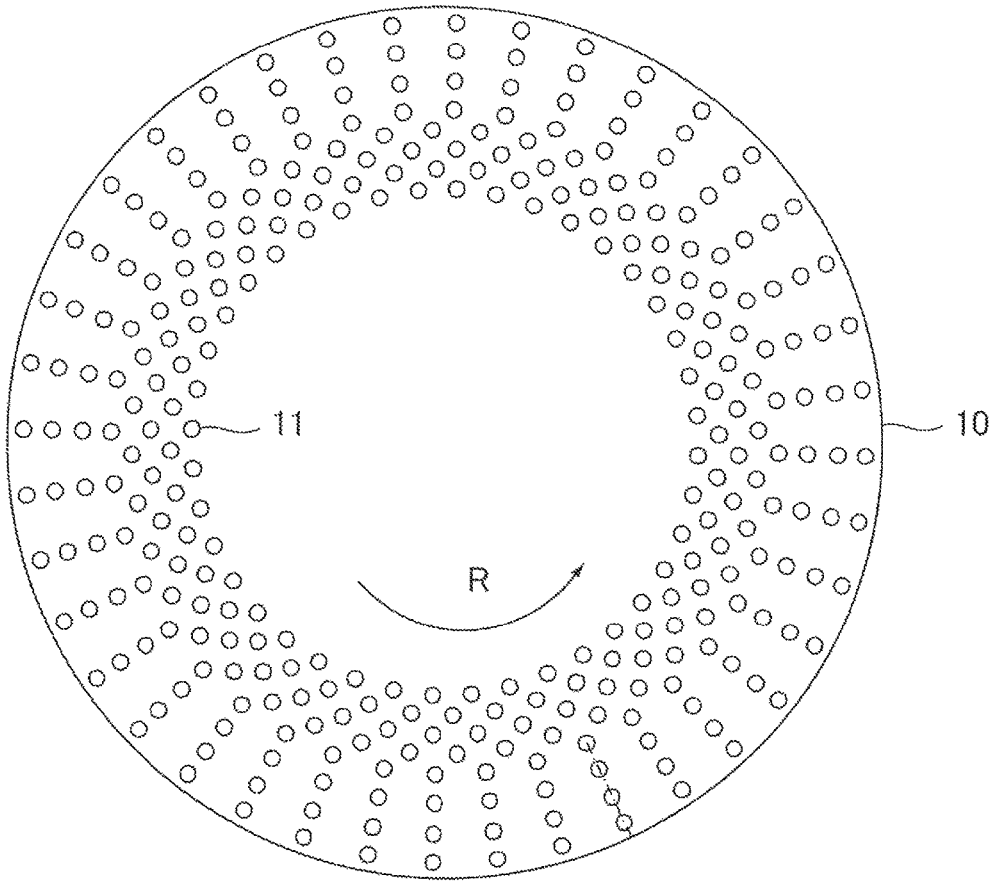
FIG. 28 is a transverse sectional view illustrating a state where the number of heating tubes is increased based on FIG. 25.

FIG. 28 illustrates an example of form in which inside parts of the heating tubes 11, 11 . . . are arranged in a shape of curved line in accordance with the second arrangement form, and outside parts of the heating tubes 11, 11 . . . are arranged along a radial direction.

Figure 25:
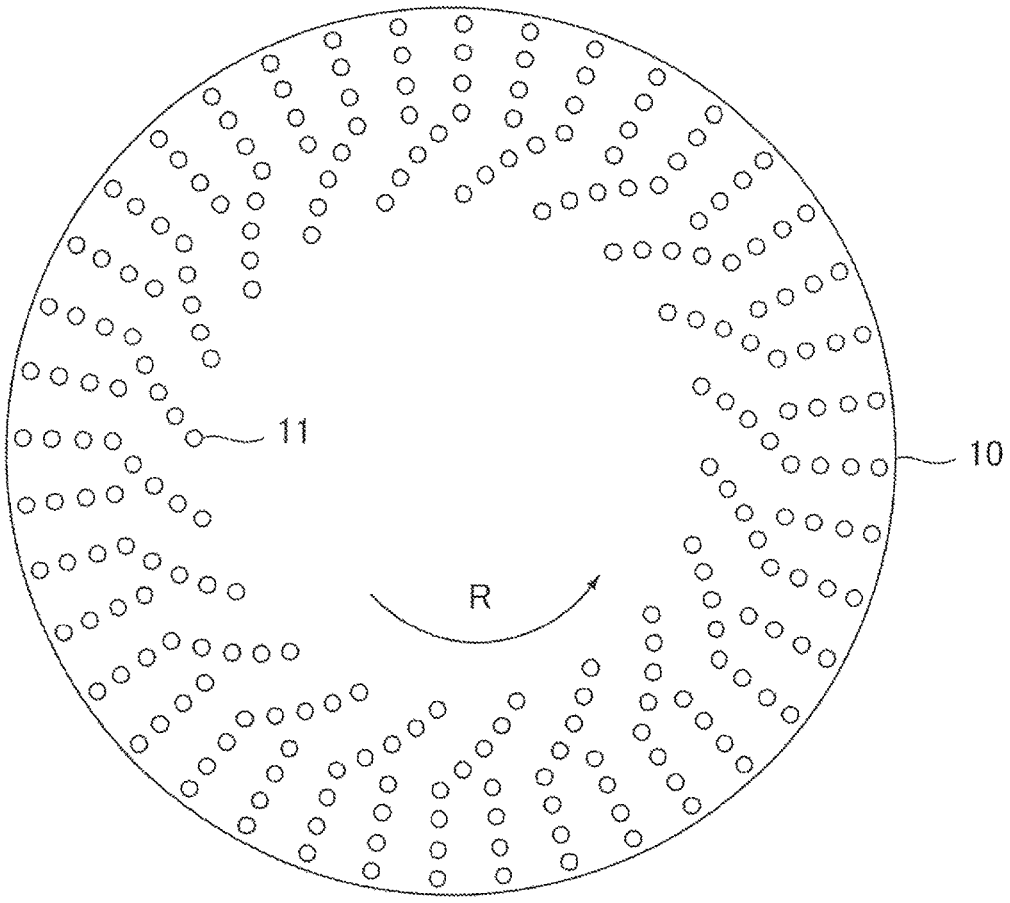
FIG. 25 is a transverse sectional view illustrating an example of arrangement of the heating tubes of the horizontal rotary dryer according to the present invention.
Figure 26:
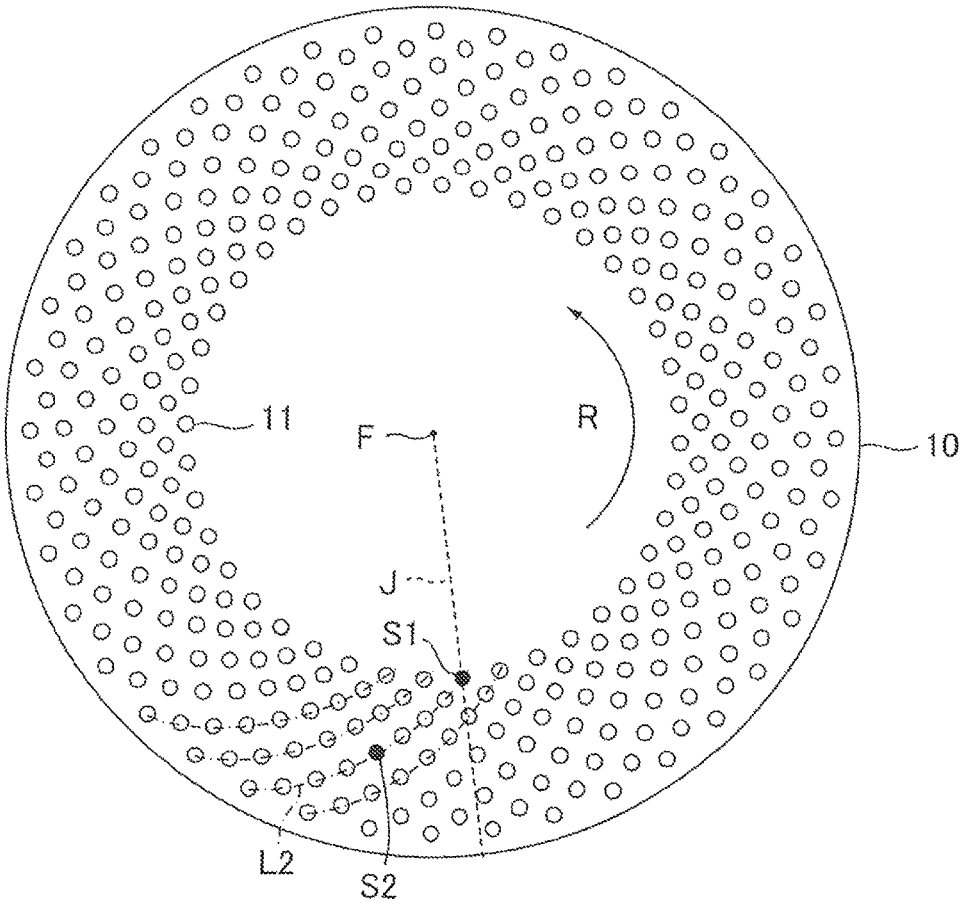
FIG. 26 is a transverse sectional view illustrating a state where the number of heating tubes is increased based on FIG. 22.

FIG. 25 illustrates an example of form in which inside parts of the heating tubes 11, 11 . . . are arranged in a shape of curved line in accordance with the second arrangement form, and outside parts of the heating tubes 11, 11 . . . are arranged along a radial direction.

Figure 27:
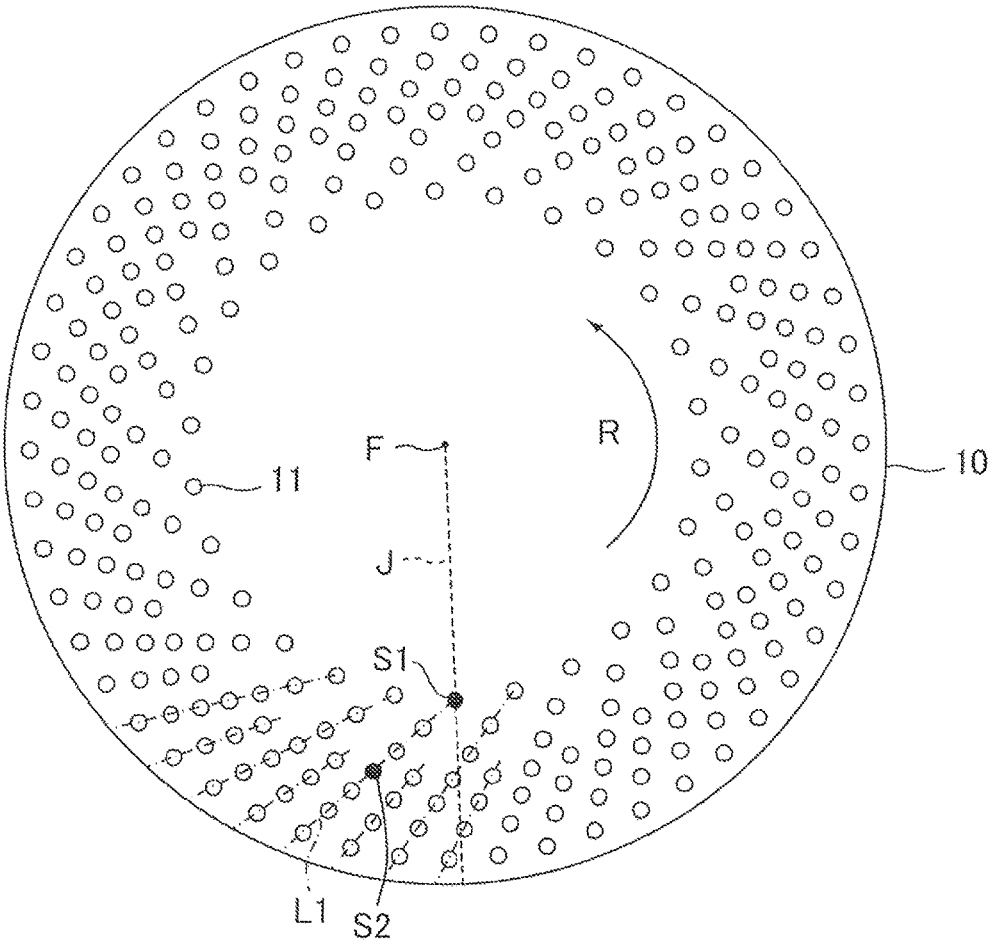
FIG. 27 is a transverse sectional view illustrating a state where the number of heating tubes is increased based on FIG. 24.

FIG. 27 illustrates an example in which the heating tubes 11, 11 . . . are arranged in a shape of diagonal straight line in accordance with the first arrangement form, in which regarding the outside parts, rows of heating tubes 11, 11 . . . arranged in a shape of diagonal straight line are interposed from positions on an intermediate concentric circle toward the outermost concentric circle.

On the other hand, as can be estimated based on these examples, it is also possible to arrange the heating tubes by combining the first arrangement form and the second arrangement form, although a concrete example thereof is not illustrated in the drawing.

Regarding all of the columns, when the first arrangement form and the second arrangement form are not employed, but, these arrangement forms are employed up to the middle of the columns, it is also desirable that the arrangement ratio $\epsilon$=h2 (from the concentric circle r2 on which the second reference heating tube S2 is positioned to the concentric circle r1 on which the first reference (innermost) heating tube S1 is positioned)/h1 (from the inner surface of the rotating shell to the concentric circle r1 on which the first reference (innermost) heating tube S1 is positioned), is set to greater than ½.

(Operation and Effect)

By arranging the heating tubes 11 in the shape of curved line or diagonal straight line as described above, the direction in which the processing material W falls and the direction in which the processing material W enters between the plurality of heating tubes 11 are approximated, resulting in that the fallen processing material W enters the gap between the plurality of heating tubes 11, 11 without greatly changing its moving direction. The processing material W which enters the gap between the heating tubes 11, 11 flows from the inside toward the outside of the rotating shell 10, and reaches a shell wall of the rotating shell 10. By selecting the arrangement of the heating tubes 11, the processing material W immediately enters the gap between the heating tubes 11 and does not remain on the outside of the heating tubes 11 (center side of the rotating shell 10), so that the contact between the processing material W and the heating tubes 11 becomes good, which enables to improve the drying efficiency. Further, the contact area between the processing material W and the heating tubes 11 increases, and the contact time between the both also increases, and also from that point, it is possible to improve the drying efficiency.

Further, since the processing material W smoothly enters the gap between the heating tubes 11, 11, impact received by the heating tube 11 from the processing material W becomes small. For this reason, when compared to a case where the heating tubes 11 are arranged in the conventional manner, the diameter of the heating tube 11 can be reduced, and the number of heating tubes 11 can be increased. As a result of this, the heat transfer area of the heating tubes 11 is increased as a whole, which enables to improve the drying efficiency.

Other than the above, in the conventional device, crush of the processing material W (granular material) has occurred due to collision between the fallen processing material W and the heating tube 11, but, according to the above-described preferred embodiments, it is possible to prevent or suppress the crush. As a result of this, the particle size distribution of the final product (dried product) is stabilized, and at the same time, fine powder is reduced, which enables to reduce the load on the exhaust gas processing facility.

Note that the diameter and the wall thickness of each of the heating tubes 11, 11 . . . can be appropriately selected.

(Number of Heating Tubes 11)

Although it is possible that all of the numbers of heating tubes 11 on the respective concentric circles are set to be the same, when the heating tubes 11 are provided in a shape of straight line, the number of heating tubes 11 from the outermost periphery to the vicinity of the middle of the rotating shell 10 is preferably set to be larger than the number of heating tubes 11 from the vicinity of the middle to the innermost periphery of the rotating shell 10, as illustrated in FIG. 27. By increasing the number of heating tubes 11 from the vicinity of the middle to the outermost periphery of the rotating shell 10 as described above, the distance between the adjacent heating tubes 11, 11 can be set to approximately the same from the innermost periphery to the outermost periphery. Further, by increasing the number of heating tubes 11, the heat transfer area of the heating tubes 11 increases, which enables to improve the drying efficiency of the processing material W moved to the outer peripheral side of the rotating shell 10.

(Diameter of Heating Tube 11)

Although all of the heating tubes 11 may have the same diameter, it is also possible to design such that, as illustrated in FIG. 23, the diameter is gradually increased from the inner peripheral side toward the outer peripheral side of the rotating shell 10. By changing the diameters of the heating tubes 11 as described above, the distance between the adjacent heating tubes 11 can be set to approximately the same from the inner periphery to the outer periphery. By increasing the diameters of the heating tubes 11 as described above, the heat transfer area of the heating tubes 11 increases, which enables to improve the drying efficiency of the processing material W moved to the outer peripheral side of the rotating shell 10.

(Method of Deciding Arrangement of Heating Tubes 11)

A method of deciding the arrangement of the heating tubes 11 will be described with reference to FIG. 23. Note that the arrangement of the heating tubes 11 is represented by "rows and columns", in which the arrangement in a radial direction of the rotating shell 10 (direction from the center side toward the outside of the rotating shell 10) is represented by the "column", and the arrangement in a circumferential direction of the rotating shell 10 is represented by the "row".

By changing a distance between adjacent rows (distance between row 1 and row 2, for example), and a distance between adjacent columns (distance between column 1 and column 2, for example), it is possible to change dispersibility and flowability of the processing material W.

For example, when the heating tube 11 to which hatching is applied in FIG. 23 (referred to as "reference heating tube 11", hereinafter) is set as a reference, as a distance between rows, there can be considered, other than a distance between the heating tube 11 of (1) and the reference heating tube 11, and a distance between the heating tube 11 of (5) and the reference heating tube 11, a distance between the heating tube 11 of (2) and the reference heating tube 11, a distance between the heating tube 11 of (8) and the reference heating tube 11, a distance between the heating tube 11 of (4) and the reference heating tube 11, and a distance between the heating tube 11 of (6) and the reference heating tube 11, and each of these distances is set to have the above-described certain value or greater. Further, as a distance between columns, there can be considered a distance between the heating tube 11 of (3) and the reference heating tube 11, and a distance between the heating tube 11 of (7) and the reference heating tube 11, and each of these distances is also set to have the above-described certain value or greater. Note that the distance between the adjacent heating tubes 11 is preferably set to 80 to 150 mm.

As described above, the distance between rows and the distance between columns become restriction conditions at the time of deciding the arrangement of the heating tubes 11. Various variations are tested while changing the diameters of the heating tubes 11, the number of rows, and the number of columns so that the heat transfer area becomes as large as possible and the flowability is improved, while complying with the restriction conditions, and as a result of this, the arrangement with which the heat transfer area becomes the largest and the flowability is improved is adopted, and a product is designed. Note that as a result of actually studying the arrangement of the heating tubes 11, when a curvature of the row was gradually increased, by gradually decreasing the diameters of the heating tubes 11 and gradually increasing the number of columns, it was possible to realize the largest heat transfer area. On the contrary, when the curvature of the row was gradually decreased, by gradually increasing the diameters of the heating tubes 11 and gradually decreasing the number of columns, it was possible to realize the largest heat transfer area.

EXPLANATION OF NUMERALS AND SYMBOLS

10 rotating shell
11 steam tube (heating tube)
41 feed port
50 discharge port
55 classification hood
56 fixed exhaust gas opening
57 fixed discharge port
60 lifter
65 agitating unit
A carrier gas
E processed material
W processing material

The invention claimed is:

1. A drying method for processing material using a horizontal rotary dryer provided with: a rotating shell having a feed port for processing material on one end side thereof and a discharge port for processing material on the other end side thereof, and capable of freely rotating around an axial center; and a group of heating tubes through which a heating medium passes, provided within the rotating shell, and configured in a manner that the processing material is lifted up in a rotational direction by the group of heating tubes in accordance with the rotation of the rotating shell, the drying method for processing material comprising drying, through indirect heating, the processing material by using the group of heating tubes in a process of feeding the processing material to the one end side of the rotating shell and discharging the processing material from an other end side of the rotating shell, wherein the rotating shell is rotated to make a critical speed ratio α defined by the following expression 1 and expression 2 become 30 to less than 100% to dry the processing material, $$Vc=2.21D^{1/2} \quad \text{Expression 1}$$

$$\alpha=V/Vc\cdot 100 \quad \text{Expression 2}$$

wherein Vc indicates a critical speed (m/s), D indicates an inside diameter (m) of the rotating shell, a indicates the critical speed ratio (%), and V indicates a rotation speed (m/s).

2. The drying method for processing material according to claim 1, wherein the processing material is fed into the rotating shell to make a hold up ratio η of the processing material defined by a following expression 3 become 20 to 40%, $$\eta=Ap/Af\cdot 100 \quad \text{Expression 3}$$

wherein η indicates the hold up ratio (%), Ap indicates a cross-sectional area ($m^2$) occupied by the processing material with respect to a free cross-sectional area, and Af indicates a free cross-sectional area ($m^2$) as a result of subtracting a cross-sectional area of all of the heating tubes from the entire cross-sectional area of the rotating shell.

3. The drying method for processing material according to claim 1 wherein when the processing material is coal whose median diameter is 50 mm or less, the rotating shell with an inside diameter of 1 to 6 m is used, and the rotating shell is rotated to make the critical speed ratio α become 40 to less than 100% to dry the processing material.

4. The drying method for processing material according to claim 1, wherein when the processing material is a resin-based material whose median diameter is 200 μm or less, the rotating shell with an inside diameter of 1 to 6 m is used, and the rotating shell is rotated to make the critical speed ratio α become 30 to 70% to dry the processing material.

5. The drying method for processing material according to claim 1, wherein a plurality of the heating tubes are arranged in a radial manner or on concentric circles, and a separation distance between adjacent heating tubes is 80 to 150 mm.

6. A horizontal rotary dryer, comprising: a rotating shell having a feed port for processing material on one end side thereof and a discharge port for processing material on an other end side thereof, and capable of freely rotating around an axial center; and a group of heating tubes through which a heating medium passes, provided within the rotating shell, configured in a manner that the processing material is lifted up in a rotational direction by the group of heating tubes in accordance with the rotation of the rotating shell, and drying, through indirect heating, the processing material by using the group of heating tubes in a process of feeding the processing material to the one end side of the rotating shell and discharging the processing material from the other end side of the rotating shell, wherein the horizontal rotary dryer is configured to be able to operate to make a critical speed ratio α defined by the following expression 1 and expression 2 become 30 to less than 100%, $$Vc=2.21D^{1/2} \quad \text{Expression 1}$$

$$\alpha=V/Vc\cdot 100 \quad \text{Expression 2 wherein}$$

Vc indicates a critical speed (m/s), D indicates an inside diameter (m) of the rotating shell, a indicates the critical speed ratio (%), and V indicates a rotation speed (m/s).

7. The horizontal rotary dryer according to claim 6, wherein a plurality of the heating tubes are arranged in a radial manner or on concentric circles, and a separation distance between adjacent heating tubes is 80 to 150 mm.

8. The drying method for processing material according to claim 2, wherein when the processing material is coal whose median diameter is 50 mm or less, the rotating shell with an inside diameter of 1 to 6 m is used, and the rotating shell is rotated to make the critical speed ratio α become 40 to less than 100% to dry the processing material.

9. The drying method for processing material according to claim 2, wherein when the processing material is a resin-based material whose median diameter is 200 μm or less, the rotating shell with an inside diameter of 1 to 6 m is used, and the rotating shell is rotated to make the critical speed ratio α become 30 to 70% to dry the processing material.

10. The drying method for processing material according to claim 2, wherein a plurality of the heating tubes are arranged in a radial manner or on concentric circles, and a separation distance between adjacent heating tubes is 80 to 150 mm.

* * * * *